US005146269A

United States Patent [19]

Shimizu et al.

[11] Patent Number: 5,146,269

[45] Date of Patent: Sep. 8, 1992

[54] IMAGE FORMING APPARATUS HAVING SELF-DIAGNOSTIC FUNCTION

[75] Inventors: Tadafumi Shimizu; Masahide Ueda, both of Osaka, Japan

[73] Assignee: Minolta Camera Kabushiki Kaisha, Osaka, Japan

[21] Appl. No.: 541,750

[22] Filed: Jun. 21, 1990

[30] Foreign Application Priority Data

| | | | |
|---|---|---|---|
| Jun. 23, 1989 | [JP] | Japan | 1-161850 |
| Jun. 23, 1989 | [JP] | Japan | 1-161851 |
| Jun. 23, 1989 | [JP] | Japan | 1-161852 |
| Jun. 23, 1989 | [JP] | Japan | 1-161853 |
| Jun. 23, 1989 | [JP] | Japan | 1-161854 |
| Jun. 23, 1989 | [JP] | Japan | 1-161855 |
| Jun. 23, 1989 | [JP] | Japan | 1-161856 |

[51] Int. Cl.[5] ..... G03G 15/00

[52] U.S. Cl. ..... 355/200; 355/206; 355/209

[58] Field of Search ..... 355/203-209, 355/214, 216; 346/160; 371/29.1

[56] References Cited

U.S. PATENT DOCUMENTS

| | | | |
|---|---|---|---|
| 3,842,273 | 10/1974 | Van Buskirk | 250/324 |
| 3,997,873 | 12/1976 | Thornton | 340/149 R |
| 4,162,396 | 7/1979 | Howard et al. | 235/304 |
| 4,497,037 | 1/1985 | Kato et al. | 364/900 |
| 4,549,044 | 10/1985 | Durham | 179/5 R |
| 4,583,834 | 4/1986 | Seko et al. | 355/206 |
| 4,586,147 | 4/1986 | Tadokoro | 371/29.1 X |
| 4,809,037 | 2/1989 | Sato | 346/160 |
| 4,853,738 | 8/1989 | Rushing | 355/204 X |
| 4,855,754 | 8/1989 | Tanaka et al. | 355/206 X |
| 4,885,466 | 12/1989 | Koichi et al. | 250/324 |

FOREIGN PATENT DOCUMENTS

| | | | |
|---|---|---|---|
| 53-136838 | 11/1978 | Japan . | |
| 58-109926 | 6/1983 | Japan . | |
| 59-142559 | 8/1984 | Japan . | |
| 63-296062 | 12/1988 | Japan . | |
| 1-63177 | 3/1989 | Japan | 355/206 |

*Primary Examiner*—Joan H. Pendegrass
*Attorney, Agent, or Firm*—Burns, Doane, Swecker & Mathis

[57] ABSTRACT

A copying apparatus for forming a hard copy image through an electrophotographic process includes an image forming apparatus which can form an image on a recording paper in various density levels, and a diagnostic unit for discriminating the image forming apparatus into three states of being capable of forming a proper image, being operable but incapable of forming a proper image, and being incapable of operation. Since the image forming states of the copying apparatus are divided into three stages, appropriate operation is performed in the copying apparatus using the electrophotographic process in response to the state of the machine.

74 Claims, 31 Drawing Sheets

FIG.4

| SET LEVEL (HV LEVEL) | $SW_1$ | $SW_2$ | $SW_3$ | $SW_4$ | $SW_5$ | $SW_6$ | $SW_7$ | $SW_8$ | SURFACE POTENTIAL [V] | REMARKS |
|---|---|---|---|---|---|---|---|---|---|---|
| LEVEL1 | ON | ON | ON | ON | ON | ON | ON | ON | 590 | LOWER LIMIT |
| LEVEL2 | ON | ON | ON | ON | ON | ON | ON | — | 605 | |
| LEVEL3 | ON | ON | ON | ON | ON | ON | — | — | 620 | |
| LEVEL4 | ON | ON | ON | ON | ON | — | — | — | 635 | |
| LEVEL5 | ON | ON | ON | ON | — | — | — | — | 650 | STANDARD VALUE |
| LEVEL6 | ON | ON | ON | — | — | — | — | — | 665 | |
| LEVEL7 | ON | ON | — | — | — | — | — | — | 680 | |
| LEVEL8 | ON | — | — | — | — | — | — | — | 695 | |
| LEVEL9 | — | — | — | — | — | — | — | — | 710 | UPPER LIMIT |

FIG.7

| SET LEVEL (T/C LEVEL) | NUMBER OF LEVEL CHANGE TIMES (n) | TONER WEIGHT RATIO T/C [wt%] | OUTPUT VOLTAGE VT [V] OF TONER DENSITY SENSOR 80 | DARK POTENTIAL VO [V] | GRAY POTENTIAL Vi [V] | REMARKS |
|---|---|---|---|---|---|---|
| LEVEL1 | 0 | 5 | 2.85 | VB+430 | VB+130 | STANDARD VALUE |
| LEVEL 2 | 1 | 6 | 2.25 | VB+410 | VB+110 | |
| LEVEL3 | 2 | 7 | 1.60 | VB+390 | VB+90 | |
| LEVEL4 | 3 | 8 | 1.00 | VB+370 | VB+70 | UPPER LIMIT |

FIG.10

| SET LEVEL (VB LEVEL) | DESIRED VALUE [V] OF DEVELOPING BIAS VB - | REMARKS |
|---|---|---|
| LEVEL 1 | 180 | |
| LEVEL 2 | 190 | |
| LEVEL 3 | 200 | |
| LEVEL 4 | 210 | |
| LEVEL 5 | 220 | STANDARD VALUE |
| LEVEL 6 | 230 | |
| LEVEL 7 | 240 | |
| LEVEL 8 | 250 | |
| LEVEL 9 | 260 | |

FIG.11

| SET LEVEL (EXP LEVEL) | DESIRED VALUE [LUX-SEC] OF AMOUNT OF EXPOSURE | REMARKS |
|---|---|---|
| LEVEL 1 | 1.60 | |
| LEVEL 2 | 1.70 | |
| LEVEL 3 | 1.80 | |
| LEVEL 4 | 1.90 | |
| LEVEL 5 | 2.00 | STANDARD VALUE |
| LEVEL 6 | 2.10 | |
| LEVEL 7 | 2.20 | |
| LEVEL 8 | 2.30 | |
| LEVEL 9 | 2.40 | |

3
STATE 16
#261
n = 0 ?
NO
YES
#262
STORE COK
#264
STORE CT/C
#263
STATE ← 20
RETURN
STATE 17
#271
n = 0 ?
NO
YES
#272
STORE CVi
#273
STORE CVi & CT/C
STATE 18
#275
STORE CVR
STATE 19
#276
STORE CVO
4

STATE 20
#281
MEASURE DENSITY OF TONER IMAGE BY PHOTOSENSOR 19
#282
CALCULATE ID FROM VP
#283
FC ← 1
RETURN
STATE 21
#291
STORE CCH
#292
FC ← 1
STATE 22
#293
STORE CEXP

63 / 1 / 1
VO — 650~303
Vi — 370~304
VR — 70~305
VB — 5~306
T/C — 1~307
CH — 5~308
EXP — 9~309
ID — 1.4~310
Cvi
300
301
302
117

62 / 6 / 15 -
k1 — 3~313
k2 — 1~314
k3 — 3~315
k4 — 4~316
k5 — 1~317
k6 — 0~318
N — 180~319
311
117

CT/C — 7/31-400
CVO — 8/2-400
CVO — 8/3-400
CVO — 8/4
CVO — 8/5
CCH — 8/6
CVi — 11/2
CVi — 12/3
CVi — 12/18
CVR — 12/24
CVR — 12/25
CVR — 12/26
117

VO-DAY
300
117
321
320
322
329
328
327
326
325
324
323
331
330
332
333
334
335
336

VO-WEEK
300
117
321
320
322
349
348
347
346
345
344
343
342
359
360
361
362
363
364
365
366

IMAGE FORMING APPARATUS HAVING SELF-DIAGNOSTIC FUNCTION

BACKGROUND OF THE INVENTION

1. Field of the Invention

The present invention relates to an image forming apparatus for forming hard copy images using an electrophotographic process, and more particularly, it relates to an image forming apparatus having a self-diagnostic function.

2. Description of the Background Art

In general, an electrophotographic process is widely used for a method of forming a hard copy image in an image forming apparatus such as a copying apparatus, a facsimile, an optical printer using a laser beam or an LED array, or the like.

The electrophotographic process includes a charging process for uniformly charging the surface of a photoreceptor, an exposure process of exposing the surface of the photoreceptor in response to image formation for partially removing charges and forming a latent image, a developing process of sticking toner which is contained in a developer to the latent image for forming a toner image, transfer process of transferring the toner image onto a recording paper, and a fixing process of fixing the toner image transferred onto the recording paper.

In an image forming apparatus using such an electrophotographic process, property values such as the surface potential of the photoreceptor, the amount of exposure, toner density and the like corresponding to the respective ones of the aforementioned processes are previously determined in order to obtain a hard copy image having proper (i.e., standard) density, and operation of each mechanical part is defined in response to the property value.

In general, however, specific property values gradually deviate from the determined values, depending on the frequency of employment, environment of the place of installation and the like. In other words, the image density is varied with adhesion of an impurity to the photoreceptor, deterioration of an exposure lamp, stain of mirrors provided in an optical system, time change of the circuit constant of a control circuit, and the like. Further, sudden variation may be caused in the image density.

Therefore, a serviceman operates the image forming apparatus in routine inspection, for example, to confirm the image density from a currently formed hard copy image. In response to the result of the confirmation, he may clean a charger, replace components or change set values of the respective mechanical parts by manipulating dip switches.

In the conventional image forming apparatus, however, the serviceman cannot confirm the density of a hard copy image corresponding to an operating state (condition) previous to the inspection.

Namely, even if the density recognized in the inspection process is different from the proper density, the serviceman cannot confirm whether the difference is abruptly or gradually caused. Consequently, it is difficult to specify the cause (position of nonconformity) for the density change to take proper action. If a temporary expedient is taken in order to obtain a hard copy image of proper density, nonconformity of the apparatus may be increased.

SUMMARY OF THE INVENTION

Accordingly, an object of the present invention is to provide an image forming apparatus, which can take proper action for forming a hard copy image having proper density.

Another object of the present invention is to provide an image forming apparatus, which can be operated in response to its state.

Still another object of the present invention is to avoid waste in communication in an image forming apparatus having a self-diagnostic function and a function for communicating with a management unit.

A further object of the present invention is to provide an image forming method which can take appropriate action for forming a hard copy image having proper density.

A further object of the present invention is to provide an image forming method wherein the image forming apparatus can be operated in response to its state.

The aforementioned objects of the present invention can be attained by an image forming apparatus including the following elements: The inventive image forming apparatus includes a photoreceptor, an electrostatic latent image forming unit for forming an electrostatic latent image on the photoreceptor, a developing unit for developing the electrostatic latent image formed on the photoreceptor and forming a toner image, a transfer unit for transferring the toner image formed on the photoreceptor onto a recording paper, a measuring unit for measuring density of the toner image formed on the photoreceptor, and an estimating unit for estimating density of the image transferred onto the recording paper on the basis of the measured density and outputting estimated image density data.

In the image forming apparatus according to the present invention, image density is estimated on the basis of the density of the toner image formed on the photoreceptor and the picture quality is determined from the density of the toner image, which is a property value of the process, whereby it is possible to find out the cause for any change in the result of the picture quality. Consequently, it is possible to provide an image forming apparatus, which can take proper action for forming a hard copy image having proper density.

In another aspect of the present invention, an image forming apparatus includes image forming means which can form an image on a recording paper in various density levels, manual density adjusting means having a manual operation switch for adjusting image density in response to operation of the manual operation switch, a diagnostic unit for diagnosing if the image forming means is in a first state being capable of forming a proper image, a second state being operable but incapable of forming a proper image, or a third state being incapable of operation, control means for allowing operation of the image forming means when the same is in the first or second state and inhibiting operation of the image forming means when the same is in the third state, and warning means for giving warning in response to operation of the manual operation switch when the image forming means is in the second state.

The states of the image forming apparatus including the aforementioned elements are classified into three states, to enable action in response to the state of the apparatus. Consequently, it is possible to provide an image forming apparatus, which can be operated in response to its state.

According to still another aspect of the present invention, an image forming apparatus which is connected with a management unit through a communication line includes an image forming unit having a plurality of movable elements for forming an image on a recording paper by cooperation of the movable elements, a diagnostic unit operating the plurality of movable elements without forming any image on a recording paper for diagnosing operating states thereof and outputting diagnostic data, a memory for storing the diagnostic data, and transmission means for transmitting the diagnostic data stored in the memory to the management unit through the communication line at predetermined time.

Since the inventive image forming apparatus which is connected with the management unit through the communication line includes the aforementioned elements, the diagnostic data for the image forming apparatus are transmitted through the communication line at predetermined time. Such communication is made only when the diagnostic data for the image forming apparatus are required. Consequently, it is possible to avoid waste in communication in the image forming apparatus having a self-diagnostic function and a function for communicating with the management unit.

These and other objects, features, aspects and advantages of the present invention will become more apparent from the following detailed description of the present invention when taken in conjunction with the accompanying drawings.

BRIEF DESCRIPTION OF THE DRAWINGS

FIG. 4 illustrates set levels of the corona charger;

FIG. 7 illustrates relation between set levels of the toner weight ratio, dark potential and gray potential;

FIG. 10 illustrates set levels of developing bias;

FIG. 11 illustrates set levels of amount of exposure;

FIGS. 22A to 22K illustrate exemplary display screens appearing on a message display portion.

DESCRIPTION OF THE PREFERRED EMBODIMENTS

An embodiment of the present invention is now described with reference to the drawings.

Figure 1:
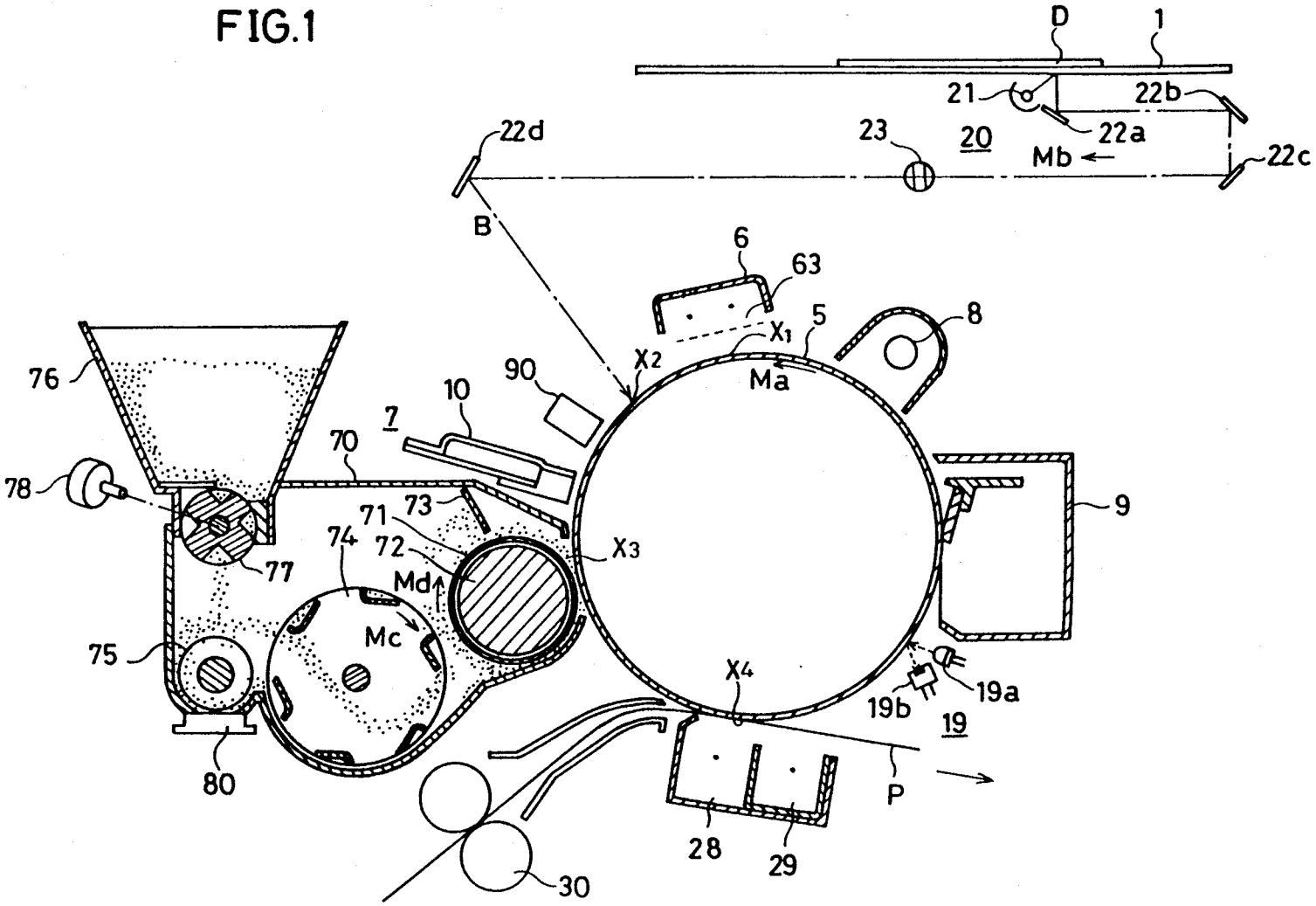
FIG. 1 is a front sectional view showing a principal part of a copying apparatus.

FIG. 1 is a front sectional view showing a principal part of a copying apparatus A. Referring to FIG. 1, a photoreceptor drum 5 is rotatable along an arrow Ma at a constant peripheral velocity v, while a corona charger 6, an image-to-image eraser 10, a developing unit 7, a transfer charger 28, a copy paper separation charger 29, a cleaning unit 9, and a main eraser 8 for an electrophotographic process are provided around the photoreceptor drum 5. A surface electrometer 90 is provided between an exposure position X2 and the image-to-image eraser 10 for measuring the surface potential of the photoreceptor drum 5, while a reflector type photosensor 19 which is formed by a light emitting element **19*a* and a light receiving element 19*b* is provided between the copy paper separation charger 29 and the cleaning unit 9** for measuring the density of a reference toner image.

The surface of the photoreceptor drum 5 is uniformly charged by passage through the corona charger 6, and exposed at the exposure position X2 by an optical system 20. Surface charges of the photoreceptor drum 5 are partially discharged by such exposure, so that a latent image corresponding to an original D is formed on the surface of the photoreceptor drum 5. Surface charges of portions other than the latent image are erased by the image-to-image eraser 10.

The optical system 20 is formed by an exposure lamp 21 for illuminating the original D which is placed on a platen glass 1, mirrors **22*a* to 22*d* for guiding reflected light B from the original D to the exposure position X2, and a projecting lens 23. The exposure lamp 21 and the mirror 22*a* move along an arrow Mb at a velocity v/m (m: copying magnification) in order to expose/scan the original D, while the mirrors 22*b* and 22*c*** are movable at a velocity v/2m.

The latent image formed on the surface of the photoreceptor drum 5 is developed by the developing unit 7 into a toner image.

The developing unit 7 uses a developer which is made of a mixture of a magnetic carrier and insulating toner, to perform the so-called forward rotation development of sticking the toner to the latent image (portion provided with charges, i.e., non-exposed portion) passing through a developing position X3 by a well-known magnetic brush system. A developing sleeve 71 containing a magnetic roller 72, a brush height regulating plate 73, a bucket roller 74 and a screw roller 75 are provided in the interior of a developer tank 70, while a toner density sensor 80 is provided under the screw roller 75.

When the bucket roller 74 is rotated along an arrow Mc, the developer is attracted toward the outer peripheral surface of the developing sleeve 71 by magnetic force of the magnetic roller 72, and carried to the developing position X3 on the basis of rotation of the developing sleeve 71 along an arrow Md. The toner density density 80 is adapted to measure a weight ratio T/C (toner/carrier) [wt.%] of the toner to the entire developer from permeability of the developer.

A toner tank 76 is provided on an upper portion of the developer tank 70, while a toner supply roller 77 is provided on its bottom portion. When the toner supply roller 77 is driven/rotated by a supply motor 78, the toner tank 76 supplies the toner to the screw roller 75. The supplied toner is stirred/mixed with the developer already contained in the developer tank 70 rotation of the screw roller 75, and fed to the bucket roller 74. Frictional electrification is caused by stirring/mixing therein, so that the magnetic carrier and the toner are charged with charges of opposite polarity. Negative toner is sticked to the surface of the photoreceptor drum 5 at the developing position X3 by electrostatic attraction between the same and the surface charges of the photoreceptor drum 5. At this time, a developing bias VB of a prescribed voltage is applied to the developing sleeve 71, in order to prevent adhesion of the toner by residual charges (charges remaining on the exposed portion) on the surface of the photoreceptor drum 5.

On the other hand, a paper P is fed by timing rollers 30 in timing with rotation of the photoreceptor drum 5, and the transfer charger 28 transfer the toner image onto the paper P at a transfer position X4. The paper P to which the toner image is transferred is separated from the photoreceptor drum 5 by the copy paper separation charger 29, and fed to a fixing unit (not shown).

Thereafter the cleaning unit 9 removes residual toner from the surface of the photoreceptor drum 5, and the main eraser 8 removes the residual charges for preparation for next exposure.

Figure 2:
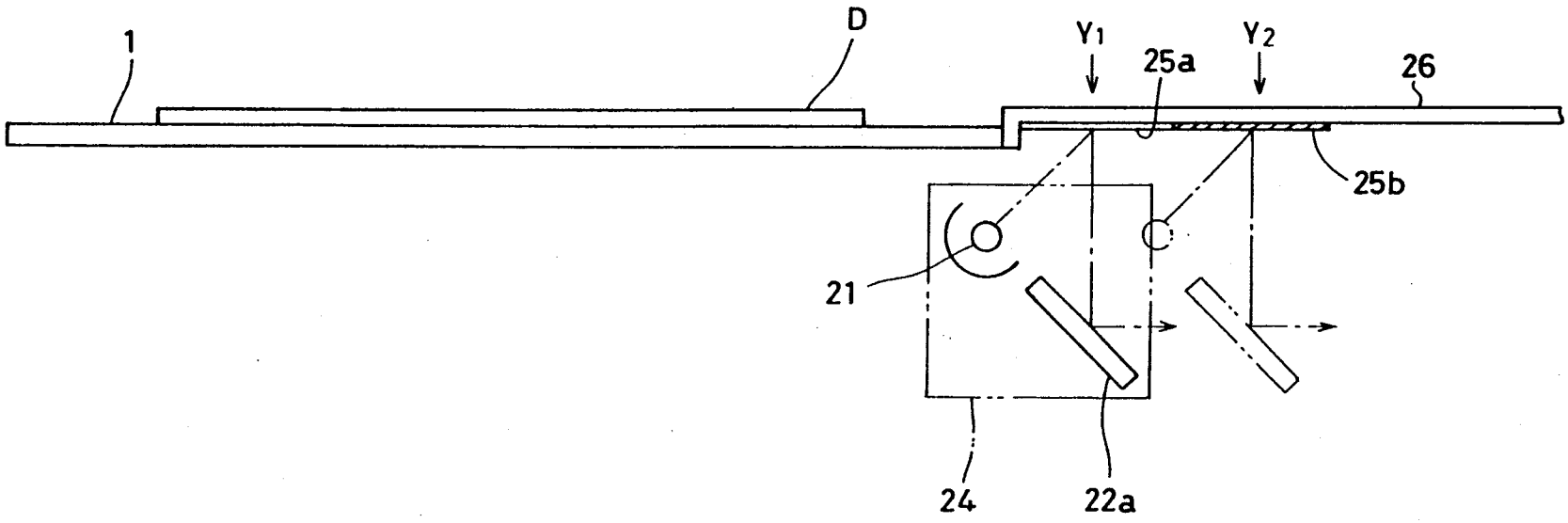
FIG. 2 is an enlarged view showing a part of an optical system.

FIG. 2 is a partially enlarged view showing the optical system 20.

A slider unit 24 supporting the exposure lamp 21 and the mirror 22*a* is reciprocable under the platen glass 1 in order to expose/scan the original D in copying operation as hereinabove described, while the same is located at an adjusting position Y1 or Y2 in image adjustment as hereinafter described.

Adjusting seals 25*a* and 25*b* are put on the lower surface of a body cover 26 for the copying apparatus A, to correspond to the adjusting positions Y1 and Y2. The adjusting seal 25*a* has reflectance which corresponds to the background (white background) of an ordinary original paper, while the adjusting seal 25*b* has reflectance which corresponds to a gray background (halftone image).

Figure 3A:
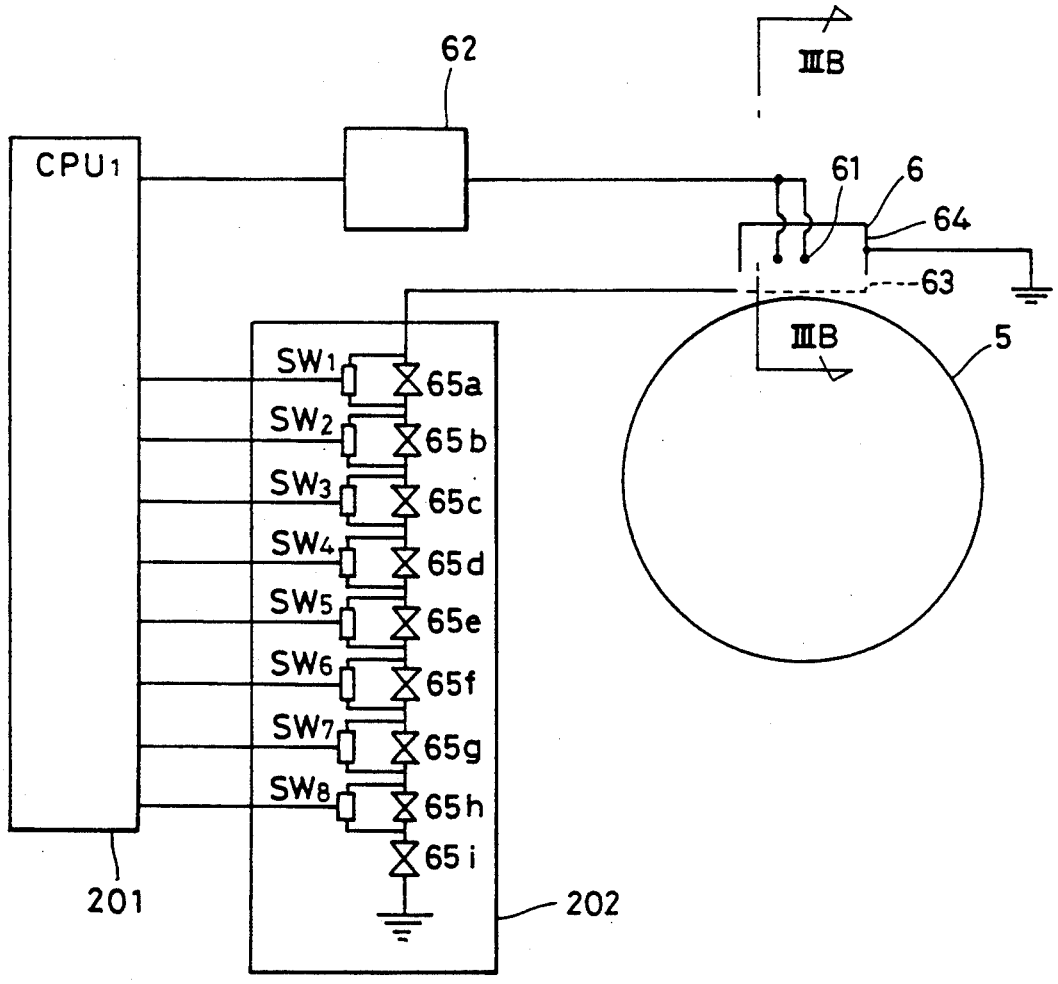
FIGS. 3A and 3B illustrate structures of a corona charger and an output circuit.

FIG. 3A illustrates the structures of the corona charger 6 and the output circuit 202.

The corona charger 6 is a scorotoron type charger which is formed by a charge wire 61, a stabilizer 64 and a mesh-type grid 63.

The charge wire 61 is supplied with a constant high voltage by a high-voltage transformer 62, which is on-off controlled by a first CPU 201 as described later. The grid 63 is grounded through series-connected varistors 65*a to* 65*i* which are provided in the output circuit 202, and respective terminals of the varistors 65*a* to 65*h* can be short-circuited by short circuiting switches SW1 to SW8. The short circuiting switches SW1 to SW8 are on-off controlled by control signals from the first CPU 201, whereby the potential of the grid 63 is controlled. Thus, the amount of charges delivered from the charge wire 61 to the surface of the photoreceptor drum 5 is controlled to set the surface potential of the photoreceptor drum 5.

Figure 3B:
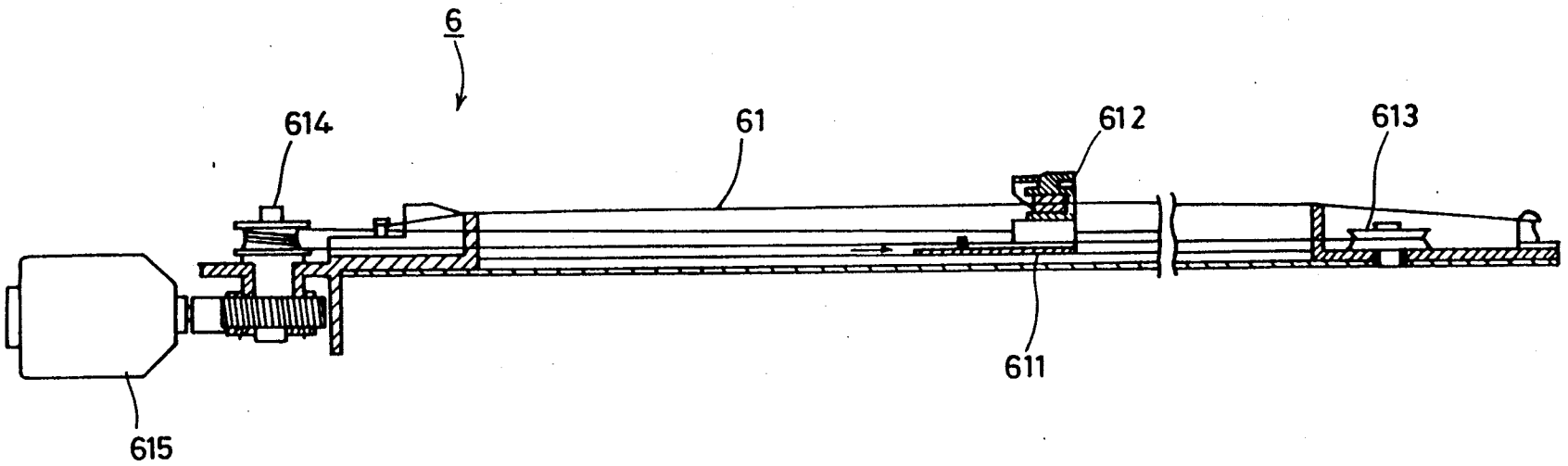

FIG. 3B is an enlarged sectional view taken along the line IIIB—IIIB in FIG. 3A. Referring to FIG. 3B, the corona charger 6 includes the charge wire 61 for performing electric discharge, and a cleaning member 612 for cleaning the charge wire 61. The cleaning member 612 is provided in a cleaning block 611, which is driven by a motor 615 between two pulleys 613 and 614 through the wire. The cleaning member 612 cleans the charge wire 61, thereby cleaning the corona charger 6.

FIG. 4 illustrates set levels of the corona charger 6. In this embodiment, rated voltages of the varistors 65*a* to 65*h* are set at 15 V and that of the varistor 65*i* is set at 790 V, so that the surface potential of the photoreceptor drum 5 can be set in nine stages of levels 1 to 9 around a standard level 5 at the pitch of 15 V. At the level 5, for example, the short circuiting switches SW1 to SW4 are turned on so that the surface potential of the photoreceptor drum 5 is 650 V. Alternatively, the rated voltages of the varistors 65*a* to 65*h* can differ from each other to increase the number of the levels.

In the following description, the set levels of the corona charger 6 are referred to as "HV levels".

Figure 5:
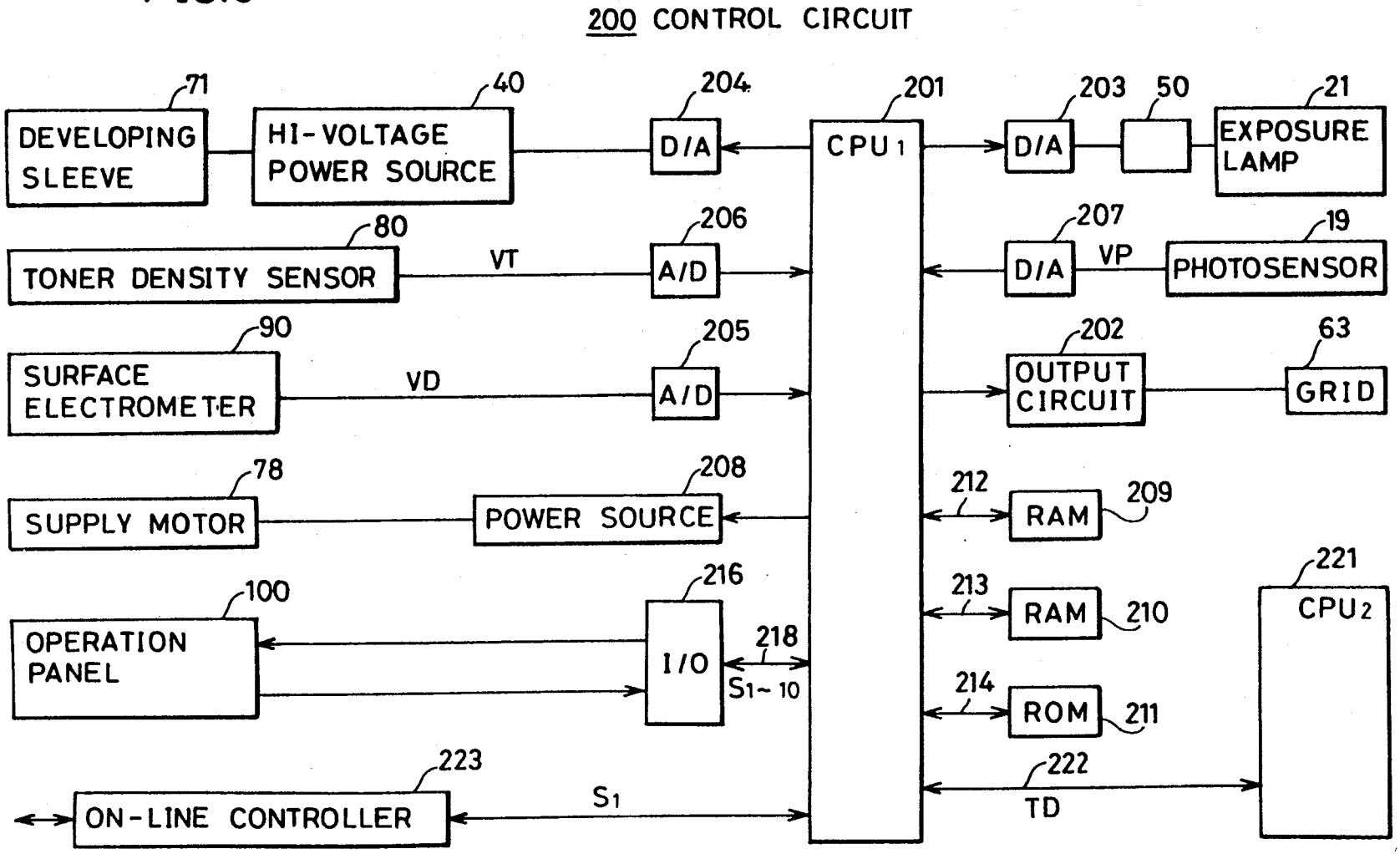
FIG. 5 is a block diagram showing a control circuit for the copying apparatus.

FIG. 5 is a block diagram showing a control circuit 200 for the copying apparatus A.

The control circuit 200 has the first CPU 201 which controls the overall copying apparatus A, a second CPU 221 having a clock function, RAMs 209 and 210, a ROM 211, and the like. The RAM 209 is backed up by a main source (not shown), and initialized when the main source is turned off. The other RAM 210 is backed up by a battery, so that data written in the RAM 210 are held regardless of on/off states of the main source. Numerals 212 to 214 denote data buses which connect the RAMs 209 and 210 and the ROM 211 with the first CPU 201 respectively.

An output voltage VD of the aforementioned surface electrometer 90, an output voltage VT of the toner density sensor 80 and an output voltage VP of the photosensor 19 are converted to digital signals by A-D converters 205 to 207 respectively and inputted in the first CPU 201. The first CPU 201 applies control signals to an exposure lamp source 50 for lighting the exposure lamp 21 and a high voltage source 40 for applying the developing bias VB through D-A converters 203 and 204. Numeral 208 denotes a power source for driving the supply motor 78, and numeral 216 denotes an interface for transferring data between an operation panel 100 as described below and the first CPU 201.

Numeral 223 denotes an online controller for communication with an external management unit 227 as described later.

Figure 9:
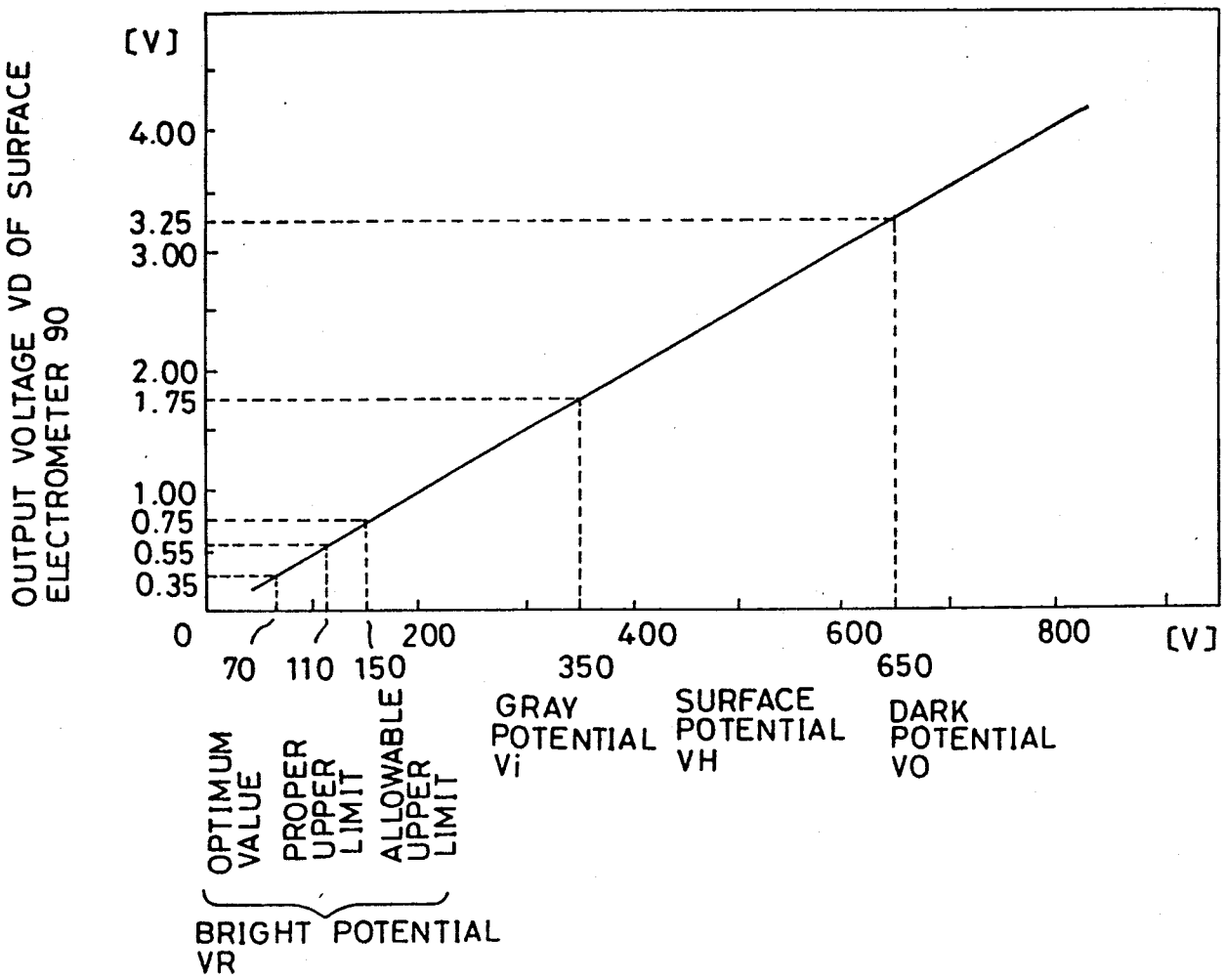
FIG. 9 is a graph showing relation between surface potential of a photoreceptor drum and output voltage of a surface electrometer.

FIG. 9 is a graph showing relation between the surface potential VH of the photoreceptor drum 5 and the output voltage VD of the surface electrometer 90.

As shown in FIG. 9, the output voltage VD is 0.35 V, 1.75 V and 3.25 V when the surface potential VH is 70 V, 350 V and 650 V respectively. The values 70 V, 350 V and 650 V of the surface potential VH are regarded as standard values for a bright potential VR, a gray potential Vi and a dark potential VO of the copying apparatus A respectively.

The bright potential VR is a potential corresponding to a portion discharged by exposure (corresponding to the white background portion of the original D), and is not reduced to 0 V even in the best state, due to residual charges. The bright potential VR is proper if the same is not more than 110 V, improper but not abnormal in excess of 110 V up to 150 V, and abnormal in excess of 150 V. In this embodiment, the potential of an exposure portion corresponding to the adjusting seal 25*a* is regarded as the bright potential VR.

The gray potential Vi is the potential of an exposed portion corresponding to the adjusting seal 25*b*, and the dark potential VO is the potential of a portion corresponding to an unexposed portion (black portion) on the surface of the photoreceptor drum 5.

The gray potential Vi, the dark potential VO and the developing bias VB are determined on the basis of the bright potential VR. The following equations (1) to (3) express optimum values corresponding to standard electrophotographic process conditions which are defined in view of configurations, materials etc. of the aforementioned photoreceptor drum 5, the developing unit 7 and the like:

$$VB = VR + 150 \quad (1)$$

$$Vi = VB + 130 \quad (2)$$

$$VO = VB + 430 \quad (3)$$

FIG. 10 illustrates set levels of the developing bias VB.

As understood from the equation (1), the optimum difference between the developing bias VB and the bright potential VR is 150 V. If the difference is smaller than 150 V, the toner adheres to the exposed portion provided with residual charges to cause the so-called background stain. If the difference exceeds 150 V, on the other hand, it leads to adhesion of the magnetic carrier.

In this embodiment, therefore, the developing bias VB can be set in nine stages at the pitch of 10 V around a level 5, the desired value of which is a standard developing bias VB (220=70+150 V), in order to cope with variations of the bright potential VR. In the following description, the set levels of the developing bias VB are referred to as "VB levels".

Figure 6:
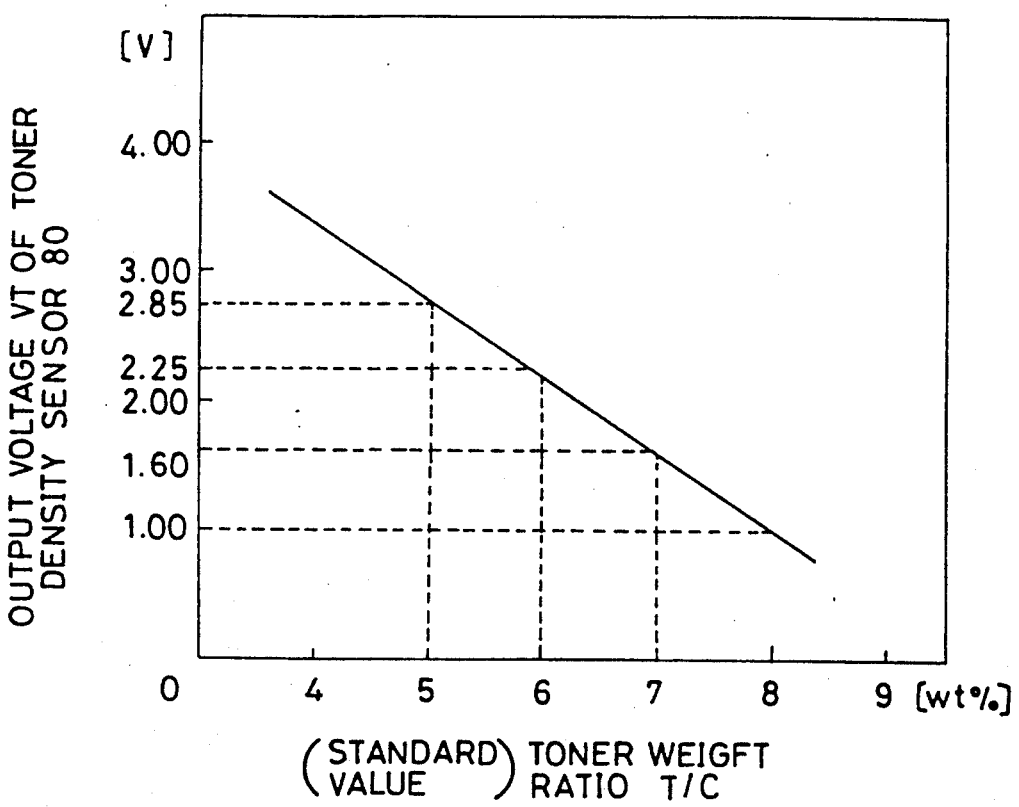
FIG. 6 is a graph showing relation between toner weight ratio and output voltage of a toner density sensor.

FIG. 6 is a graph showing relation between the toner weight ratio T/C and the output voltage VT of the toner density sensor 80.

The value of the toner weight ratio T/C defined as a standard electrophotographic condition (standard value) is 5 [wt.], and the output voltage VT of the toner density sensor 80 is 5.28 V with respect to this value. When copying operation is made in the toner weight ratio T/C set at the standard value, the first CPU 201 compares the reference potential of 2.85 V with the output voltage VT. When the output voltage VT is larger than 2.85 V, i.e., when the toner weight ratio T/C is lower than the standard value, the first CPU 201 turns on the power source 208 for the supply motor 78 to supply the toner, thereby approaching the toner weight ratio T/C to the standard value.

Such control for maintaining the toner weight ratio T/C at the set value is performed at any time during the copying operation, while the set value of the toner weight ratio T/C is changed on the basis of self diagnosis in image adjustment as described later.

FIG. 7 illustrates relation between set levels of the toner weight ratio T/C, the dark potential VO and the gray potential Vi. According to this embodiment, the toner weight ratio T/C can be set in four stages of levels 1 to 4. In the following description, the set levels of the toner weight ratio T/C are referred to as "T/C levels".

In general, efficiency of development is improved as the toner weight ratio T/C is increased. Even if potential difference between the photoreceptor drum 5 and the developing sleeve 71 is reduced, therefore, it is possible to obtain a hard copy image in proper density by increasing the toner weight ratio T/C. In the image adjustment described later, therefore, the T/C level is changed when output adjustment of the corona charger 6 reaches the limit at a standard toner weight ratio T/C, i.e., at the T/C level "1". The upper limit of the toner weight ratio T/C is defined at 8 [wt.%] since excess driving torque is applied to the bucket roller 74 and the like and the toner overflows from the developer tank 70 if the toner weight ratio T/C exceeds 8 [wt.%]:

FIG. 11 illustrates set levels of the amount of exposure.

The amount of exposure is set by controlling lighting power which is supplied from the exposure lamp source 50 to the exposure lamp 21. In the copying apparatus A, the amount of exposure can be set in nine stages within a range of 1.6 to 2.4 [Lux.sec] around a level 5, the desired value of which is 2.00 [Lux.sec]. The set levels of the amount of exposure are hereinafter referred to as "EXP levels".

Figure 8:
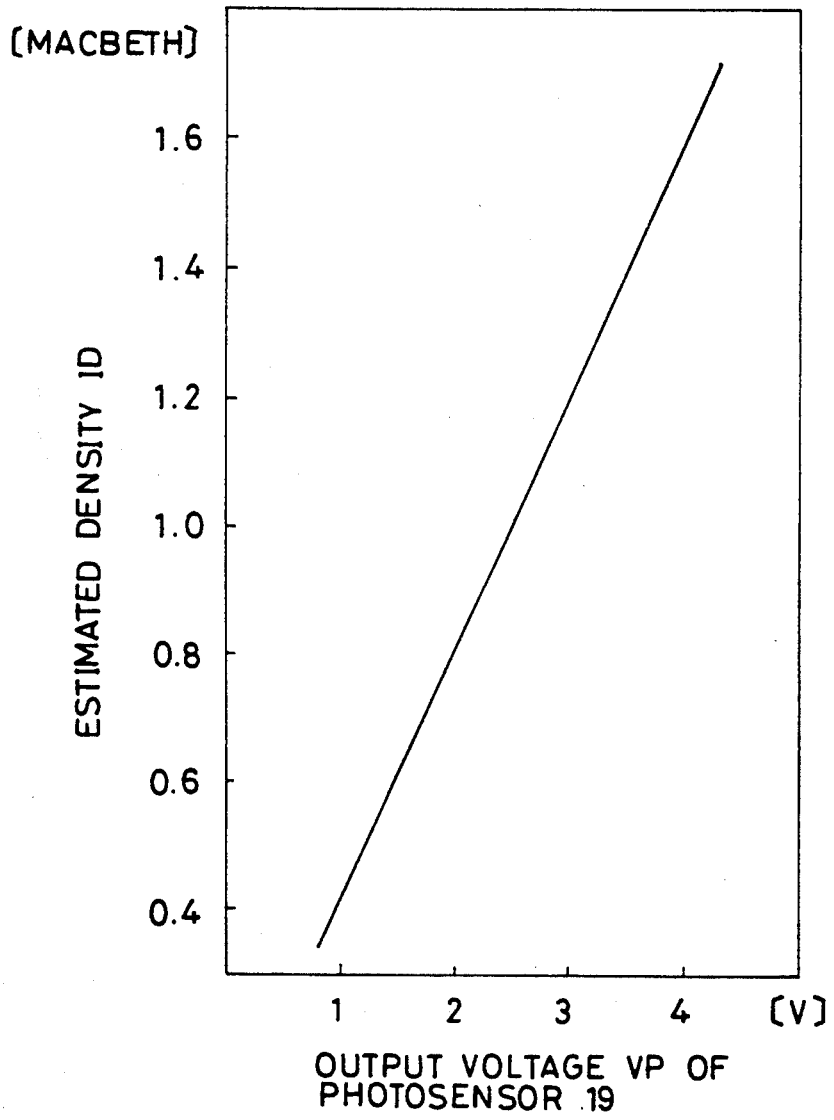
FIG. 8 is a graph showing relation between output voltage of a photosensor and estimated density.

FIG. 8 is a graph showing relation between the output voltage VP of the photosensor 19 and estimated density ID.

This graph corresponds to relation between density of a toner image formed on the photoreceptor drum 5 and density actually measured as to a hard copy image obtained by transferring/fixing the toner image onto the paper P. When the value of the output voltage VP is "2.5", for example, the density of the as-formed hard copy image can be estimated to be 1.0 [Macbeth]. Graph data GD are previously stored in the ROM 211.

The first CPU 201 refers to the data stored in the ROM 211, and calculates the estimated density ID of the hard copy image formed in the copying operation on the basis of the output voltage VP of the photosensor 19. In other words, the density of the hard copy image visually observed by an operator is estimated on the basis of the density of the toner image (reflectance of the toner image), which is one of the property values accompanying the electrophotographic process.

Figure 12:
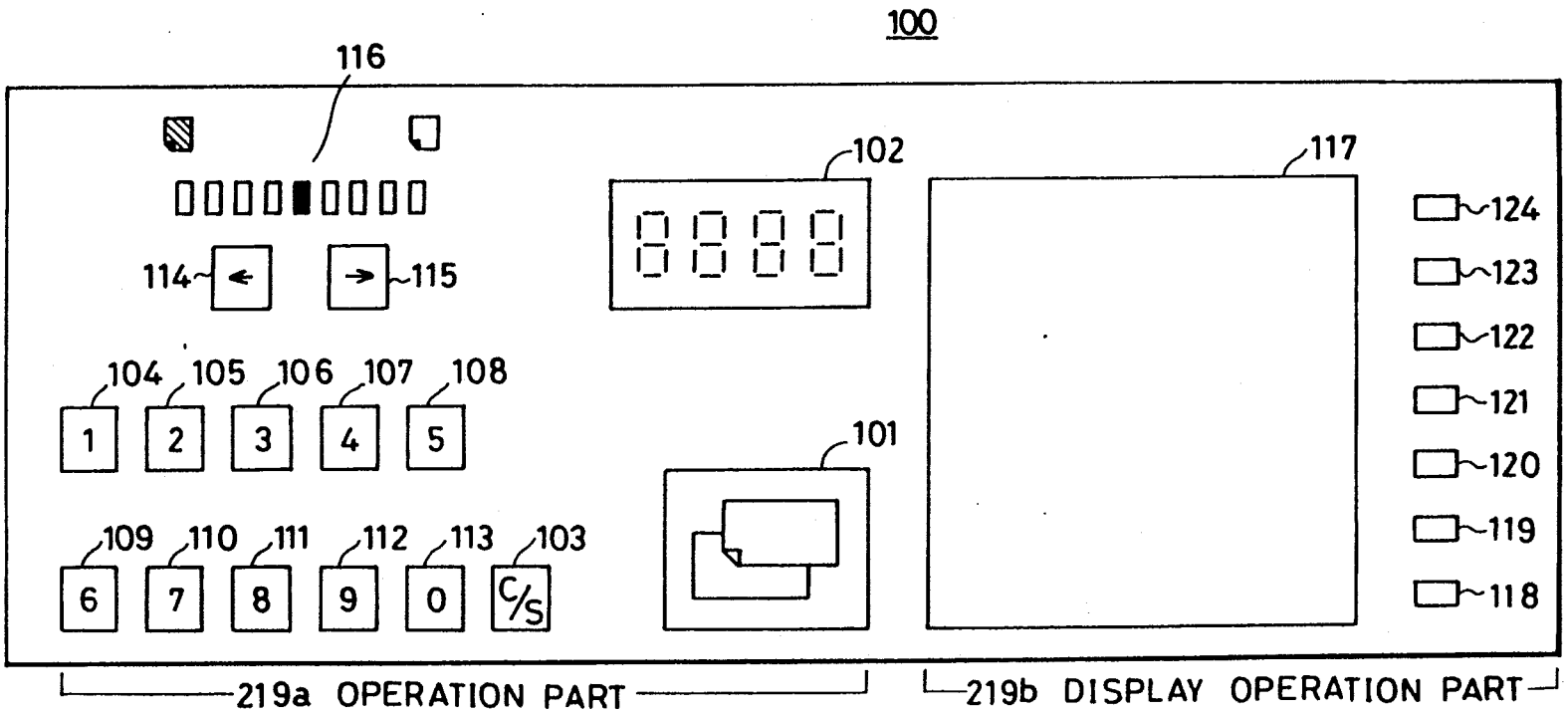
FIG. 12 is a plan view showing an operation panel of the copying apparatus.

FIG. 12 is a plan view showing an example of the operation panel 100 of the copying apparatus A.

The operation panel 100 is divided into an operation part 219 for setting copying conditions such as the number of copies, density and the like and a display operation part **219*b*** which is related to display of states of the respective parts.

The operation part **219*a* is provided with a print key 101 for starting the copying operation, a seven-segment LED 102 for displaying the number of copies and the like, ten keys 104 to 113 corresponding to numerical values of 1, 2, . . . , 9 and 0 respectively, a clear/stop key 103 for cancelling setting of the copying conditions, up and down keys 114 and 115 for stepwisely changing and setting copy image density, a density display portion 116** for displaying the copy image density, and the like.

The display operation part **219*b* is provided with a message display portion 117 of a liquid crystal display, serviceman keys 118 to 124**, and the like.

The serviceman keys 118 to 124 are mainly used in operation for maintenance by the serviceman, such as display of management information stored in the RAM 210, data processing operation and the like, as hereinafter described. The serviceman keys 118 to 124 may be covered or provided within the body, in order to prevent erroneous operation.

Figure 13:
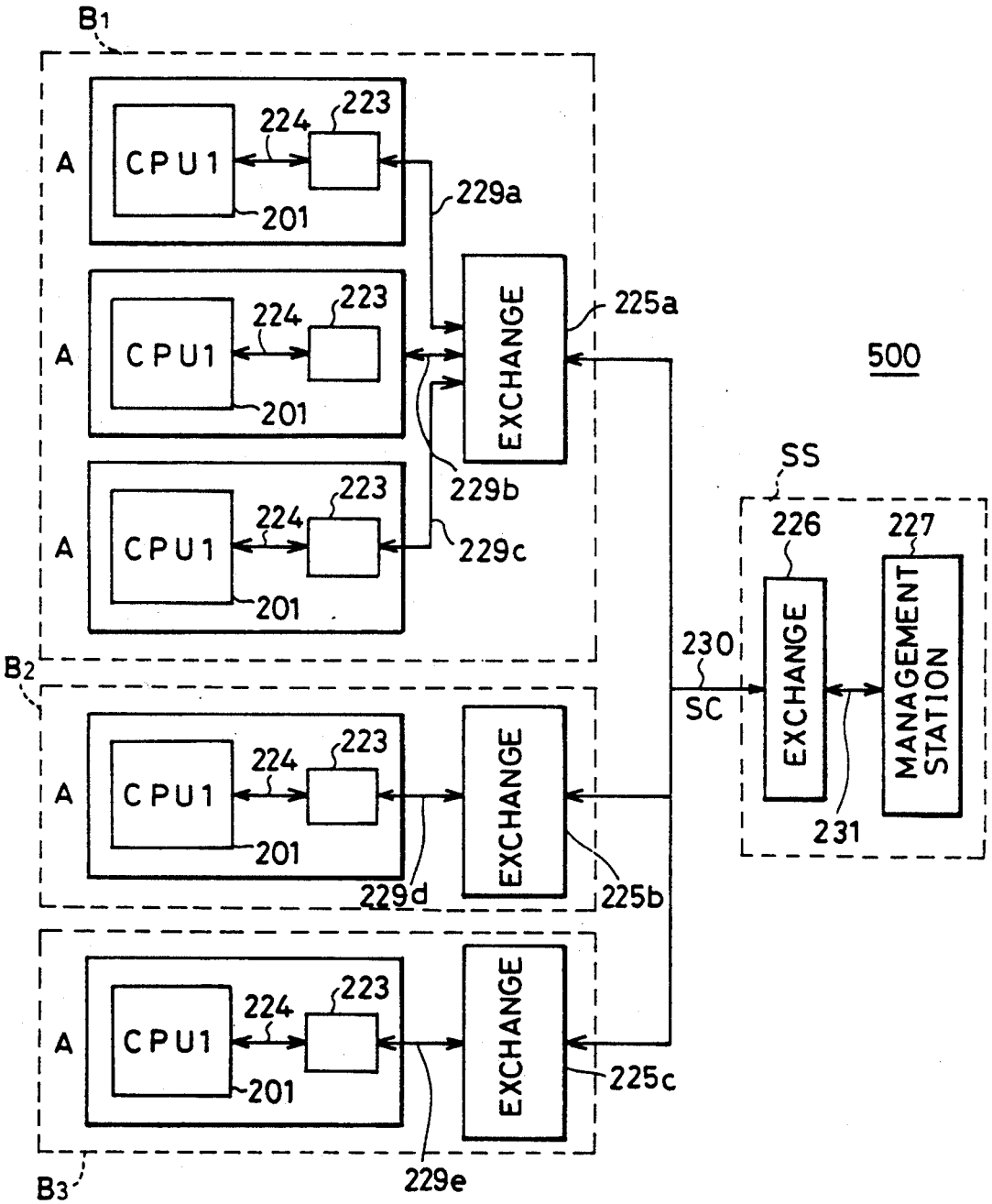
FIG. 13 is a block diagram schematically showing the structure of a man network system.

FIG. 13 is a block diagram schematically showing the structure of a management network system 500.

The management network system 500 comprises five copying apparatuses A of the same type, which are online to a management unit 227 through a telephone line 230. Three of the five apparatuses A are installed in a building B1 having an extension network which is formed by an automatic exchange **225*a* and extension lines 229*a* to 229*c*, while the remaining two apparatuses A are respectively installed in buildings B2 and B3 and connected to the telephone line 230 through automatic exchanges 225*b* and 225*c***.

In each copying apparatus A, the first CPU 201 executes timely communication processing, to transmit management information indicating the operating state thereof to a service station SS. The management information received in the service station SS is inputted in the management unit 227 through an automatic exchange 226. The serviceman can confirm the operating states of the copying apparatuses A by displaying or printing the management data inputted in the management unit 227. Thus, determinations can be made as to whether or not maintenance is required for the copying apparatuses A in a position separated from the same.

The operation of each copying apparatus A is now described with reference to flow charts shown in FIGS. 14 to 21.

Figure 14:
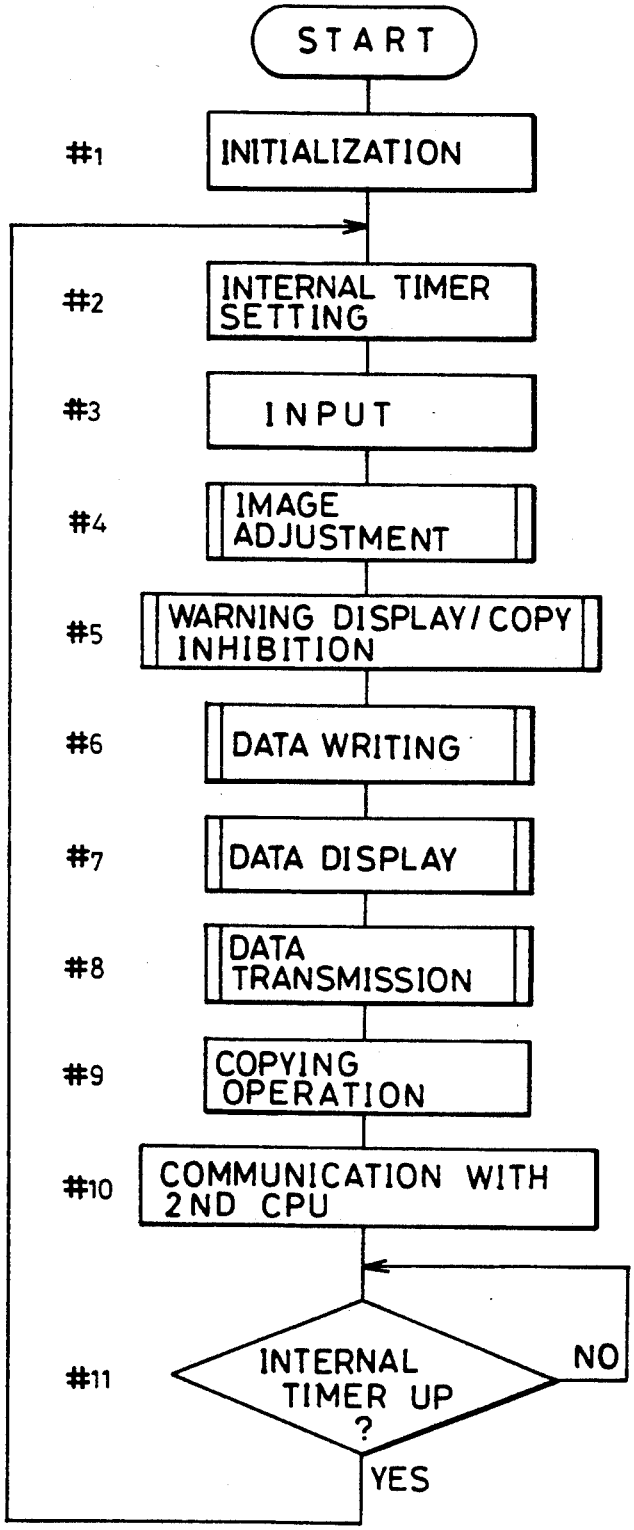
FIGS. 14 to 21 are flow charts showing the operation of the copying apparatus.
Figure 15A:
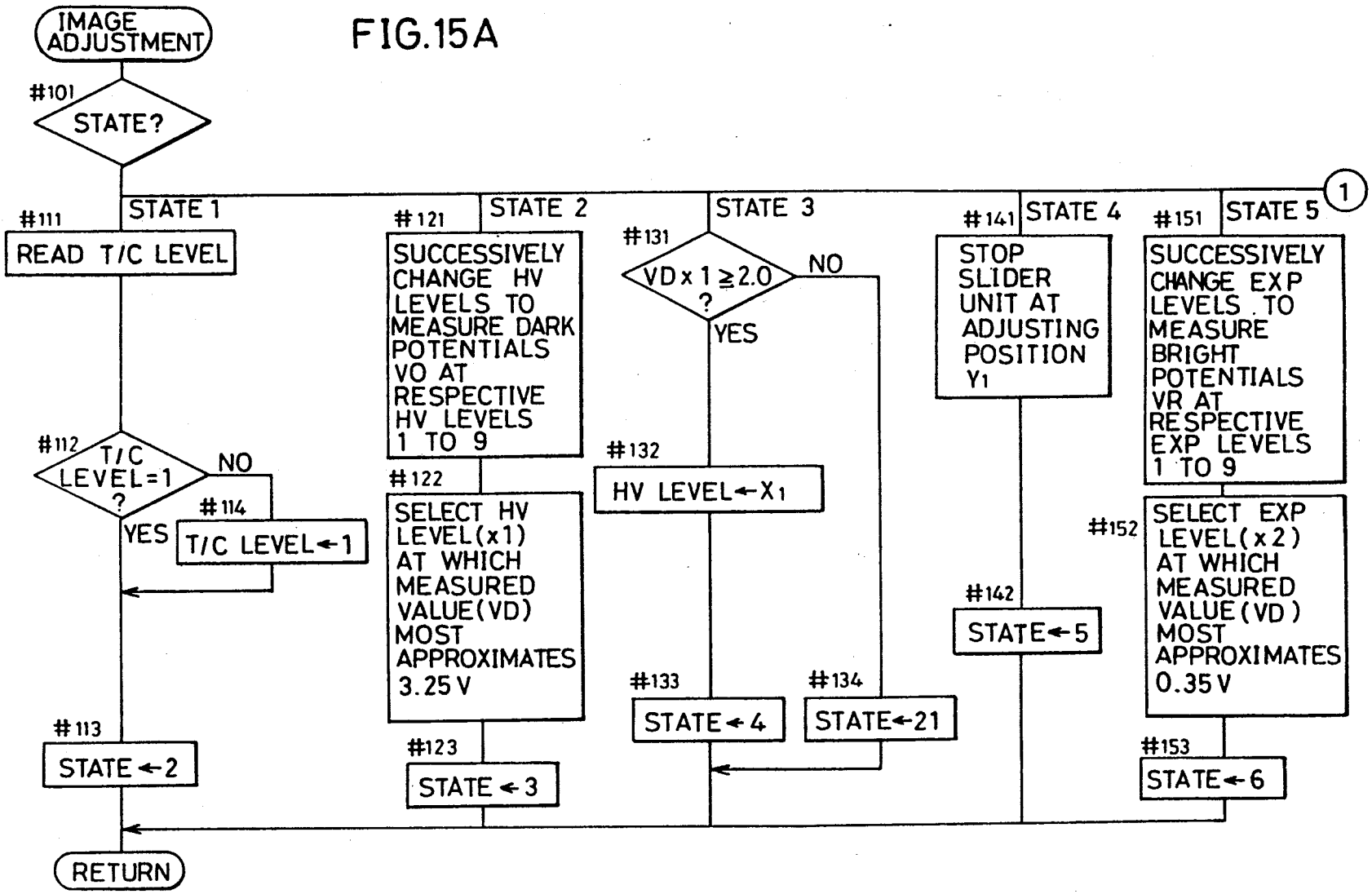
Figure 15B:
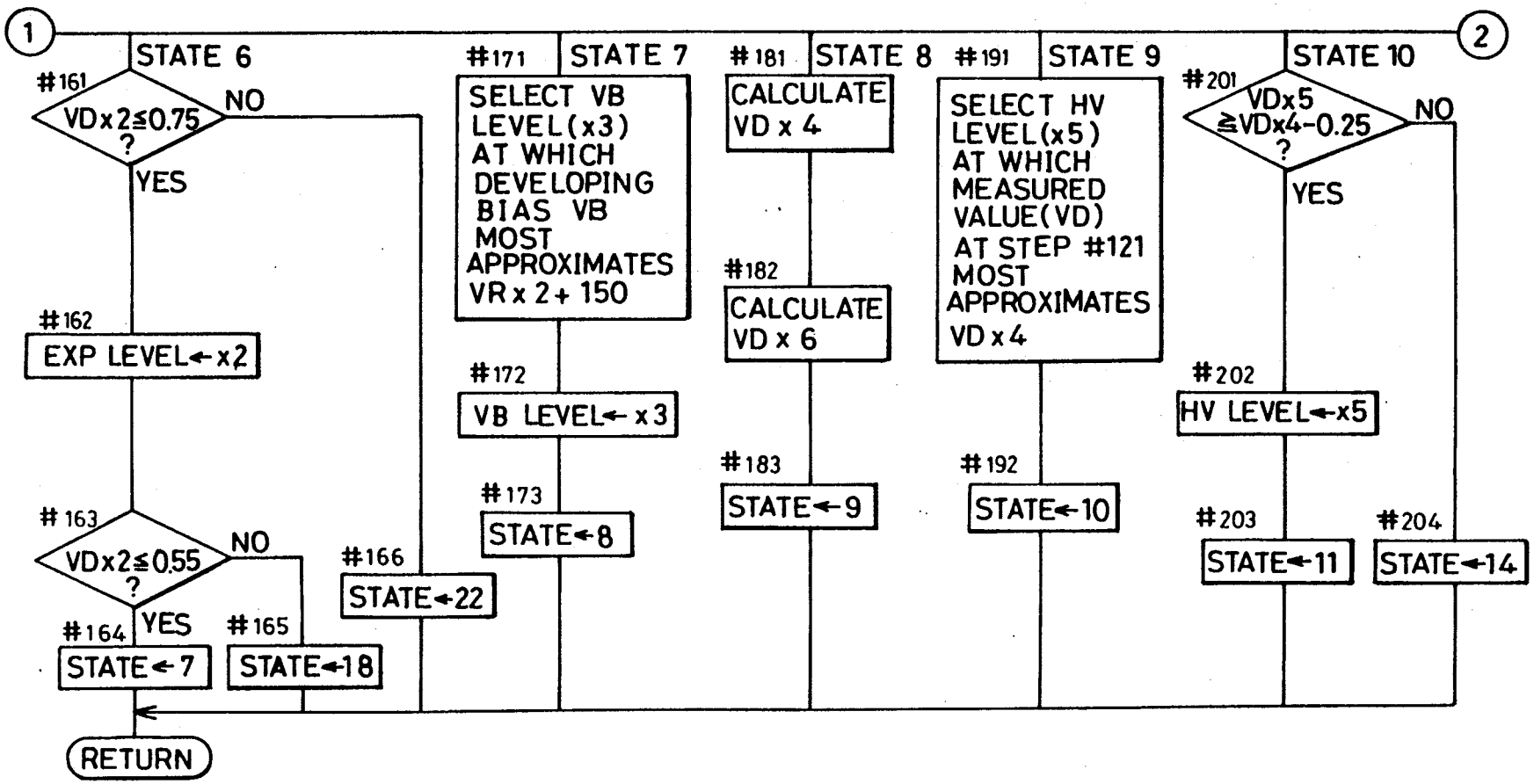
Figure 15C:
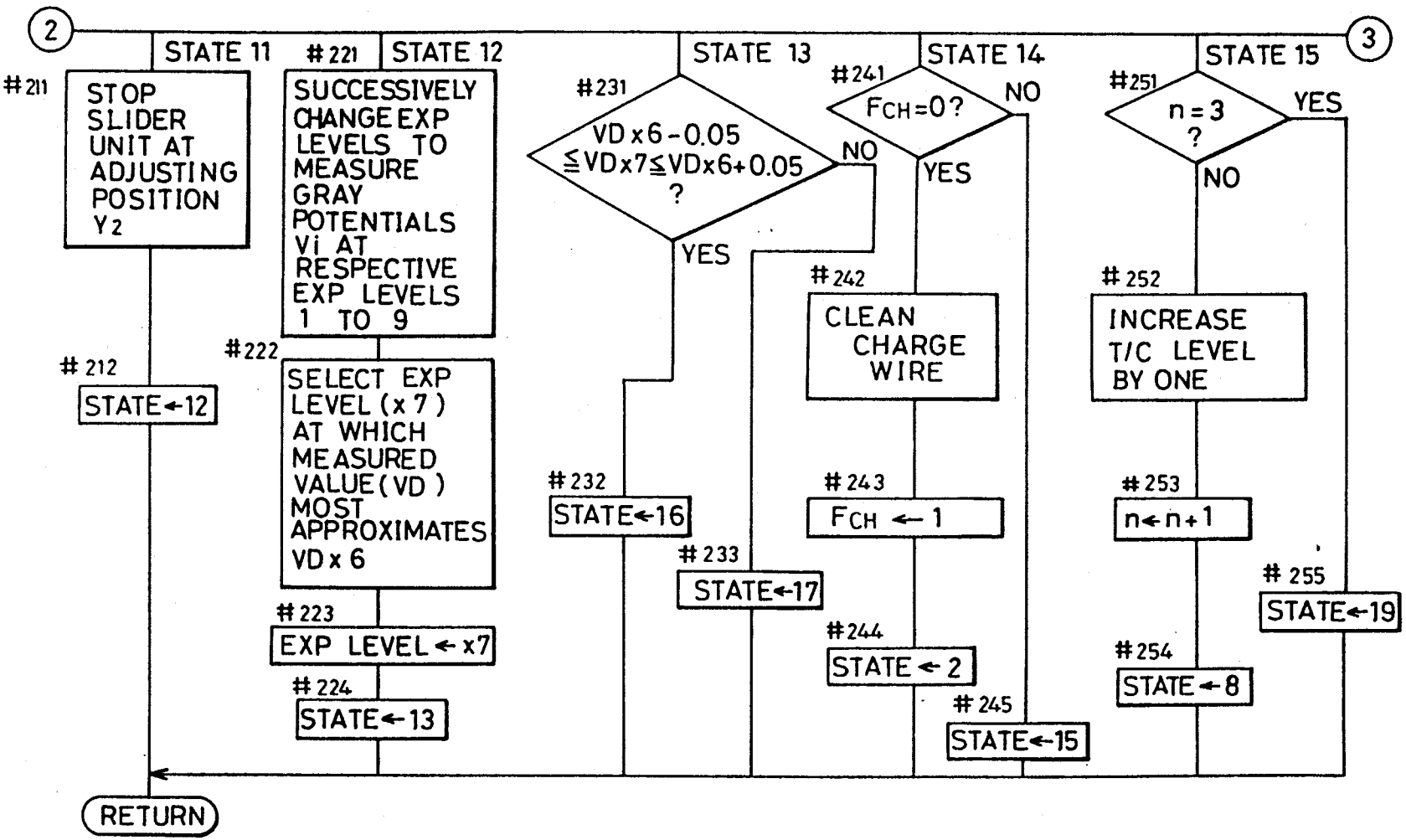
Figures 15D, 15E:
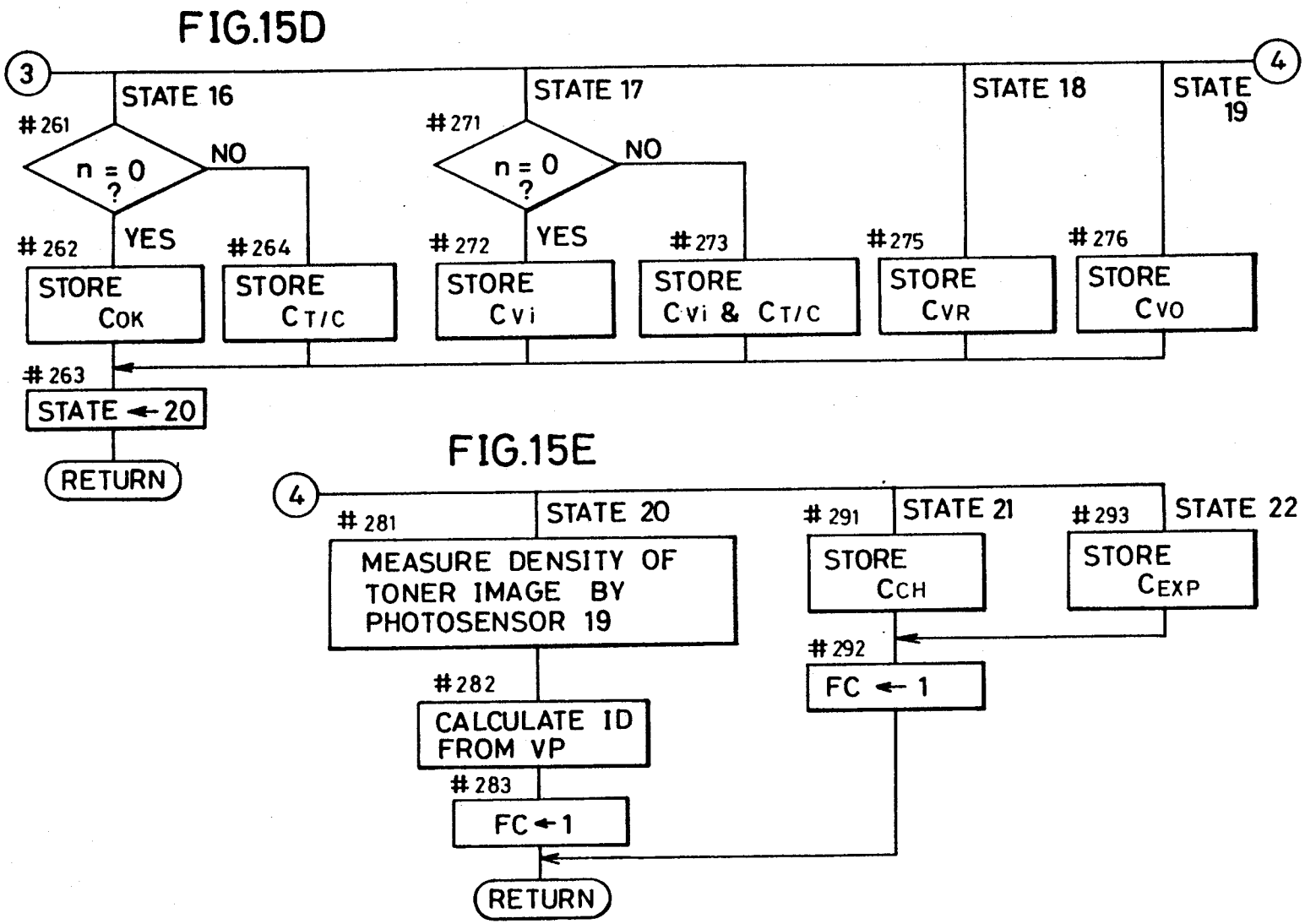

FIG. 14 is a main flow chart schematically showing the operation of the first CPU 201.

When power is turned on to start the program, the respective parts are initialized at a step #1, and an internal timer is set at a step #2 for defining the time interval for one routine of the first CPU 201.

At a step #3, input processing is performed to accept signals from the operation keys of the operation panel 100, and sensors and switches of the respective parts.

Then, image adjustment (step #4), warning display/copy inhibition (step #5), data writing (step #6), data display (step #7) and data transmission (step #8) are successively executed and thereafter copying operation is executed at a step #9.

At a step #10, communication is made with the second CPU 201.

After these processes, queuing for the internal timer is performed at a step #11 and the processing is returned to the step #2. Thus, the time interval for one routine maintained constant so that the processes of the steps #2 to #11 are repeated so far as the power is on.

FIGS. 15A to 15D are flow charts of the image adjustment at the step #4. This flow is executed only when the power is turned on.

This routine is formed by setting processing for image adjustment (states "1" to "15") for setting respective units provided around the photoreceptor drum 5 on the basis of self diagnosis for judging if the operating state of the copying apparatus A is proper, improper or abnormal, and state storage processing (states "16" to "22") for storing state data indicating states of the respective parts obtained by self diagnosis.

In this routine, the state is first checked at a step #101, to execute the following processing in accordance with the state:

In the state "1", the current T/C level is read from the RAM 209 at a step #111.

Then, a determination is made as to whether or not the T/C level is "1", i.e., whether or not the T/C level is set at a standard value (step #112), and the state is upgraded to "2" at a step #113 if the determination is of yes. If the determination at the step #112 is of no, on the other hand, the T/C level is set at "1" at a step #114 and thereafter the step #113 is executed.

In the state "2", the corona charger 6 is turned on at a step #121 to rotate the photoreceptor drum 5, and the HV levels are successively changed to measure the values of the dark potential VO at the respective HV levels "1" to "9".

At a step #122, selected is an HV level "×1" (one of the HV levels "1" to "9") at which the value measured at the step #121, i.e., the value of the output voltage VD of the surface electrometer 90 most approximates 3.25 V corresponding to the standard value (650 V) of the dark potential VO. Then the state is upgraded to "3" (step #123).

In the state "3", a determination is made at a step #131 as to whether or not a value "VD×1" of the output voltage VD at the HV level "×1" selected in the previous state "2" is at least 2.0 V. In other words, a determination is made as to whether or not the dark potential VO is in excess of a lower limit (400 V) for enabling copying operation. If the determination at the step #131 is of yes, the HV level "×1" is set as a temporary HV level at a step #132.

If the determination at the step #131 is of no, it means occurrence of significant nonconformity (trouble) such as breaking of the charge wire 61 of the corona charger 6, and execution of the copying operation is impossible. namely, the operating state of the copying apparatus A is abnormal. In this case, the state is upgraded to "21" (step #134).

In the state "4", the slider unit 24 of the optical system 20 is stopped in the aforementioned adjusting position Y1 (step #141), and the state is upgraded to "5" (step #142).

In the state "5", the EXP levels are successively changed at a step #151 to illuminate the adjusting seal 25*a*, thereby measuring the values of the bright potential VR at the respective EXP levels "1" to "9".

At a step #152, selected is an EXP level "×2" at which the value of the output voltage VD of the surface electrometer 90 measured at the step #151 most approximates 0.35 V corresponding to the standard value (70 V) of the bright potential VR. Then the state is upgraded to "6" (step #153).

In the state "6", a determination is made as to whether or not a value "VD×2" of the output voltage VD at the EXP level "×2" is not more than 0.75 V at a step #161. In other words, a determination is made as to whether or not the bright potential VO is not more than an upper limit (150 V) for enabling the copying operation.

If the determination at the step #161 is of no, it means occurrence of a trouble such as a failure of the exposure lamp 21, and the copying operation is impossible. namely, the operating state of the copying apparatus A is abnormal. In this case, the processing is shifted to a step #166 to upgrade the state to "22".

If the determination at the step #161 is of yes, on the other hand, the EXP level "×2" is set as a temporary EXP level at a step #162.

At a subsequent step #163, a determination is made as to whether or not the actually measured value "VD×2" is not more than 0.55 V.

If the determination at the step #163 is of yes, it is possible to set a developing bias VB satisfying the aforementioned equation (1), to form a copy image having proper picture quality. The operating state of the copying apparatus A is proper. In this case, the state is upgraded to "7" at a step #164.

If the determination at the step #163 is of no, on the other hand, execution of the copying operation is possible but it is impossible to set a developing bias VB satisfying the equation (1) even if the VB level "9" of the adjustment limit is selected, and the picture quality of the copy image may be improper. Thus, the operating state of the copying apparatus A is improper. In this case, the state is upgraded to "18" (step #165).

In the state "7", the developing bias VB, which is one of the electrophotographic process conditions, is determined.

Namely, a value "VR×2" of the bright potential VR corresponding to the aforementioned actually measured value "VD×2" is calculated to select a VB level "×3" at which the desired value of the developing bias VB most approximates "VR×2"+150" V (step #171), and the VB level "×3" is set as the VB level (step #172). Assuming that the actually measured value "VD×2" is 0.35 V, for example, the value "VR×2" of the bright potential VR corresponding thereto is the optimum value of 70 V (see FIG. 9), and the VB level is set at "5" (see FIG. 10), the desired value of which is 220 (70+150) V. Then the state is updated to "8" at a step #173.

In the state "8", the value "VB×3" of the developing bias VB at the VB level "×3" is substituted in the equation (3) at a step #181, to calculate a value "VD×4" of the output voltage VD corresponding to a desired value "VO×4" of the dark potential VO.

Then, the value "VB×3" is substituted in the equation (2) at a step #182, to calculate a value "VD×6" of the gray potential Vi. Then, the state is upgraded to "9" at a step #183.

In the state "9", selected is an HV level "×5" at which the measured value (value of the output voltage VD) at the step #121 in the above state "2" most approximates the calculated value "VD×4" (step #191), and the state is upgraded to "10" (step #192).

In the state "10", it is confirmed at a step #201 whether or not the actual dark potential VO is within a proper range which is determined in response to the desired value evaluated by calculation. In other words, a determination is made as to whether or not relation between the actually measured value "VD×5" of the output voltage VD corresponding to the HV level "×5" and the calculated value "VD×4" satisfies the following equation (4):

$$VD\times5 \geqq VD\times4-0.25\ [V] \quad (4)$$

The difference of 0.25 V in the output voltage VD is that of 50 V in terms of the surface potential VH.

If the determination at the step #201 is of yes, the dark potential VO is proper and hence the HV level is set at "×5" (step #202), and the state is upgraded to "11" (step #203).

If the determination at the step #201 is of no, on the other hand, the state is upgraded to "14" at a step #204. In this case, the dark potential VO is lower than a proper value, and the operating state is improper. If the copying operation is executed in such an improper state, the amount of adhesion of the toner is small and a pale image is formed.

In the state "11", the slider unit 24 is stopped at the adjusting position Y2 (step #211), and the state is upgraded to "12" (step #212).

In the state "12", the EXP levels are successively changed at a step #221 to illuminate the adjusting seal 25b, thereby measuring the values of the gray potential Vi at the respective EXP levels "1" to "9".

Then, selected is an EXP level "×7" at which the value of the output voltage VD measured at the previous step #221 most approximates the aforementioned calculated value "VD×6" (step #221), and the level "×7" is selected as the EXP level (step #222). Then the state is upgraded to "13" at a step #223.

In the state "13", it is confirmed at a step #231 whether or not the actual gray potential Vi is within a proper range (Vi×6±10 V) determined in response to the desired value "Vi×6" evaluated by calculation. That is, a determination is made as to whether or not relation between an actually measured value "VD×7" of the output voltage VD corresponding to the EXP level "×7" and the calculated value "VD×6" satisfies the following equation (5):

$$VD\times6-0.05 \leqq VD\times7 \leqq VD\times6+0.05\ [V] \quad (5)$$

If the determination at the step #231 is of yes, the gray potential Vi is proper and the processing is advanced to a step #232 to upgrade the state to "16".

If the determination at the step #231 is of no, on the other hand, the gray potential Vi is improper and the state is upgraded to "17" at a step #233.

The state "14" is executed when the dark potential VO is determined to be improper in the aforementioned state "10". At a step #241, a determination is made as to whether or not a charger flag $F_{CH}$ indicating the cleaned state of the charge wire 61 is "0".

If the determination at the step #241 is of yes, the charge wire 61 is not cleaned, and the cause for the improper value of the dark potential VO may be stain of the charge wire 61. Therefore, the charge wire 61 is cleaned at a step #242. Thereafter the charger flag $F_{CH}$ is set at "1" at a step #243, and the state is changed to "2" at a step #244. If the determination at the step #241 is of yes, therefore, the processes following the state "2" are executed after cleaning of the charge wire 61.

If the determination at the step #241 is of no, a proper value of the dark potential VO cannot be obtained although the charge wire 61 is already cleaned. In this case, the state is changed to "15" at a step #245.

In the state "15", a determination is made at a step #251 as to whether or not the number n of change of the T/C levels is "3".

If the determination at the step #251 is of no, the processing is advanced to a step #252 to increase the T/C level by one. That is, setting of the T/C level is changed to increase the toner weight ratio T/C. If the T/C level is currently set at "1", for example, the level is changed to "2". Then, "1" is added to the current number n at a step #253, and the state is changed to "8" at a step #254.

Thus, if the determination at the step #251 is of no, respective desired values of the dark potential VO and the gray potential Vi corresponding to the new T/C level are calculated and the HV level and the EXP level are so set as to obtain a proper image on the basis of the desired values.

If the determination at the step #251 is of yes, the T/C level, which is set at "4", already reaches the limit of adjustment, and hence the state is upgraded to "19" at a step #255 with no change of the T/C level.

In the state "16", a determination is made at a step #261 as to whether or not the number n of change is "0". If the determination at the step #261 is of yes, the T/C level is set at the standard level "1", and hence a state data $C_{OK}$ indicating that the T/C level is proper is stored at a step #262. In this routine, storage is made by storing data in the RAM 209.

If the determination at the step #261 is of no, on the other hand, a state data $C_{T/C}$ indicating that the T/C level is improper is stored at a step #264. After the step

#262 or #264 is executed, the state is upgraded to "20" at a step #263.

In the state "17", a determination is made at a step #271 as to whether or not the number n of change is "0", to store a state data $C_{Vi}$ indicating that the gray potential Vi is improper (step #272) if the determination is of yes, while the state data $C_{Vi}$ and $C_{T/C}$ are stored if the determination is of no (step #273). After the step #272 or #273 is executed, the processing is advanced to the aforementioned step #263.

In the state "18", a state data $C_{VR}$ indicating that the bright potential VR is improper is stored (step #275), and the processing is advanced to the aforementioned step #263.

In the state "19", a state data $C_{VO}$ indicating that the dark potential VO is improper is stored (step #276), and the processing is advanced to the aforementioned step #263.

In the state "20", executed is processing for estimating density of a hard copy image according to the electrophotographic process conditions set in the aforementioned manner.

At a step #281, density values of a toner image (corresponding to black) formed with the exposure lamp 21 being turned off, a toner image (corresponding to white) formed with the exposure lamp 21 being turned on at the adjusting position Y1 and a toner image (corresponding to gray) formed with the exposure lamp 21 being turned on at the adjusting position Y2 are measured using the photosensor 19.

At a step #282, estimated density ID of the hard copy image is evaluated on the basis of the output voltage VP of the photosensor 19 and graph data GD1 stored in the ROM 211, to calculate estimated density data $ID_O$, $ID_R$ and $ID_i$ for the three hard copy images of black, white and gray respectively.

Thereafter an image adjustment termination flag FC for indicating that setting for each unit around the photoreceptor drum 5 is terminated is set at "1" at a step #283.

In the state "21", a state data $C_{CH}$ indicating that the corona charger 6 is in an abnormal state is stored on the basis of self diagnosis in the aforementioned state "3" at a step #291. Then, the image adjustment termination flag FC is set at "1" at a step #292.

In the state "22", a state data $C_{EXP}$ indicating that the exposure lamp 21 is in an abnormal state is stored (step #293) on the basis of self diagnosis in the aforementioned state "6", and the processing is advanced to the aforementioned step #292.

Figure 16:
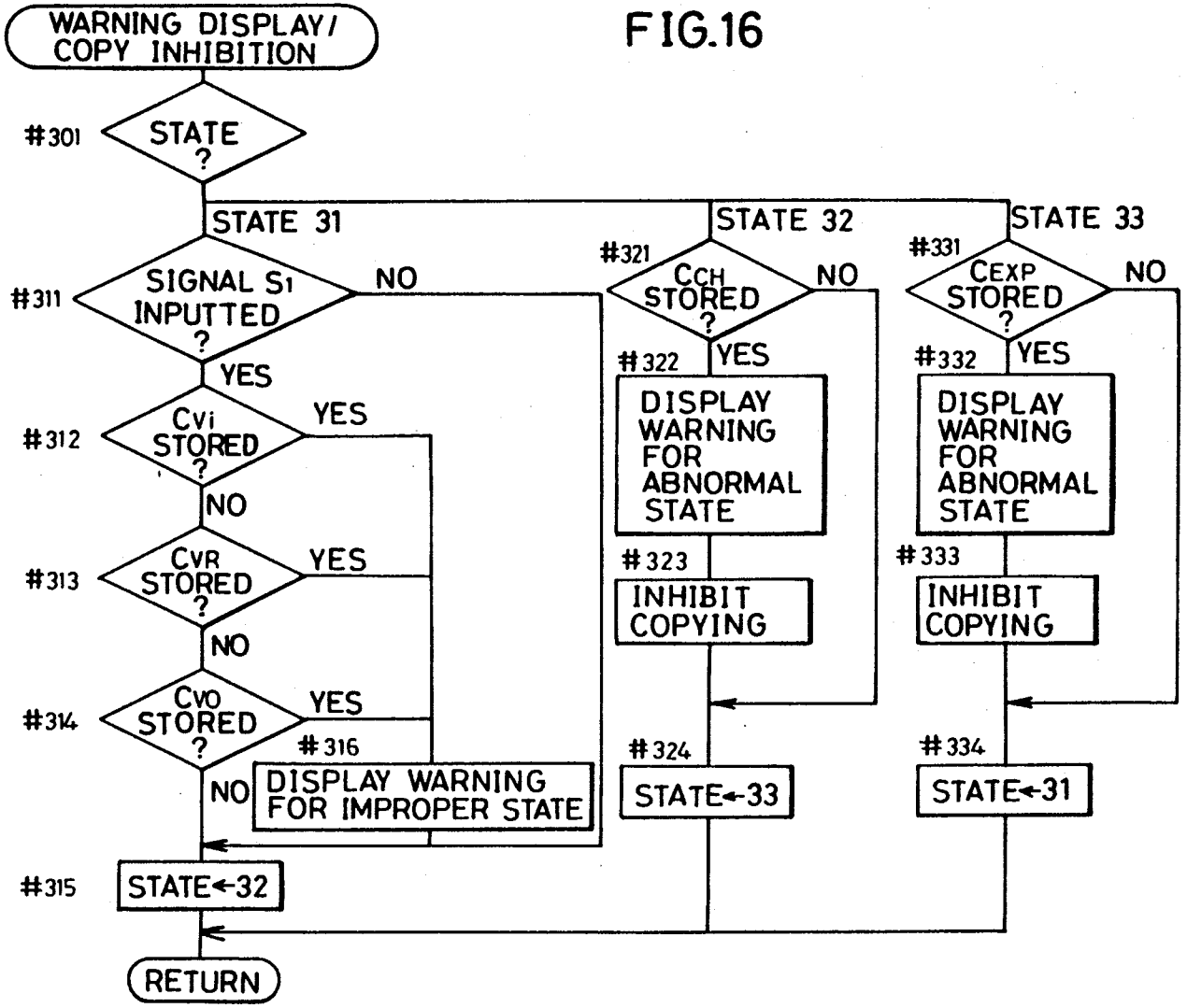

FIG. 16 is a flow chart of the warning display/copy inhibition processing at the step #5 in FIG. 14.

Also in this routine, the state is first checked at a step #301 to execute the following processing in response to the state.

In a state "31", a determination is made at a step #311 as to whether or not a signal S1 is inputted. This signal S1 is inputted in the first CPU 201 through the interface 216 when the up key 114 or the down key 115 of the operation panel 10 is pressed. If the determination at the step #311 is of no, the state is updated to "32" at a step #315.

If the determination at the step #311 is of yes, on the other hand, it means that the operator sets density, which is one element of the picture quality. In this case, it is considered that the operator pays attention particularly to the picture quality. If the operating state of the copying apparatus A is improper, therefore, it is necessary to inform the operator of the fact that formation of a copy image of desired picture quality is difficult.

Thus, determinations are made at steps #312 to #314 as to whether or not the state data $C_{Vi}$, $C_{VR}$ and $C_{VO}$ are stored respectively, i.e., whether or not the respective data are in the RAM 209. If a determination of yes is made at any one of the steps #312 to #314, the operating state of the copying apparatus A is improper. In this case, the processing is advanced to a step #316.

At the step #316, warning is displayed on the message display portion 117 of the operation panel 100 to indicate that the operating state of the copying apparatus A is improper.

FIGS. 22A to 22I illustrate examples of display screens appearing on the message display portion 117.

Figure 22A:
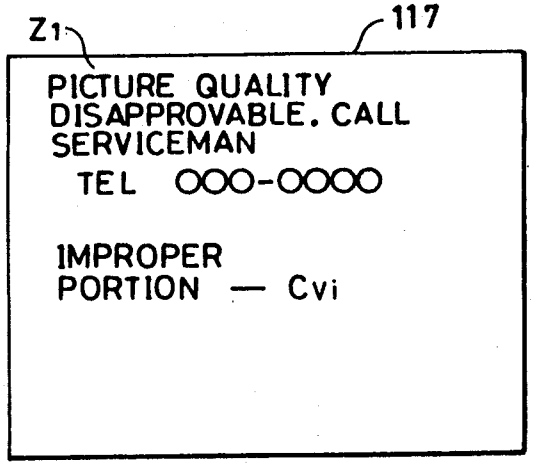

FIG. 22A shows a display screen appearing upon a determination of yes at the step #312, with a message Z1 showing an improper state and symbol "$C_{Vi}$" indicating an improper portion. Symbols "$C_{VR}$" and "$C_{VO}$" are added when determinations of yes are made at the steps #313 and #314 too.

Figure 22B:
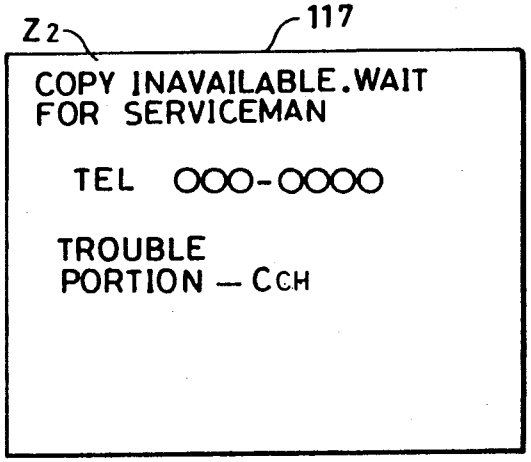

In a state "32", a determination is made at a step #321 as to whether or not the state data $C_{CH}$ is stored, to display warning of an abnormal state as shown in FIG. 22B if the determination is of yes. In this case, a message Z2 showing the abnormal state is displayed with symbol "$C_{CH}$" indicating the trouble portion (abnormal portion).

Then, copy inhibition processing is executed at a step #323 to inhibit starting of the copying operation. Namely, entry of the keys 101 and 103 to 115 in the operation panel 100 is inhibited and power sources for the respective parts are turned off except for unit related to data processing.

Thereafter the state is updated to "33" at a step #324.

Figure 22C:
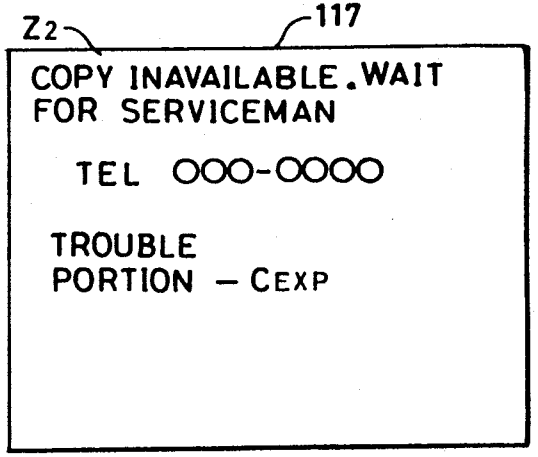

In the state "33", a determination is made at a step #331 as to whether or not the state data $C_{EXP}$ is stored, to display warning of an abnormal state as shown in FIG. 22C at a step #332 if the determination is of yes. In this case, symbol "$C_{EXP}$" indicating a trouble portion is displayed. If the warning of "$C_{CH}$" is already displayed at the step #322, symbol "$C_{EXP}$" is displayed under the symbol "$C_{CH}$".

At a step #333, copy inhibition processing similar to that at the step #323 is executed, and the state is returned to "31" at a step #334.

Figure 17A:
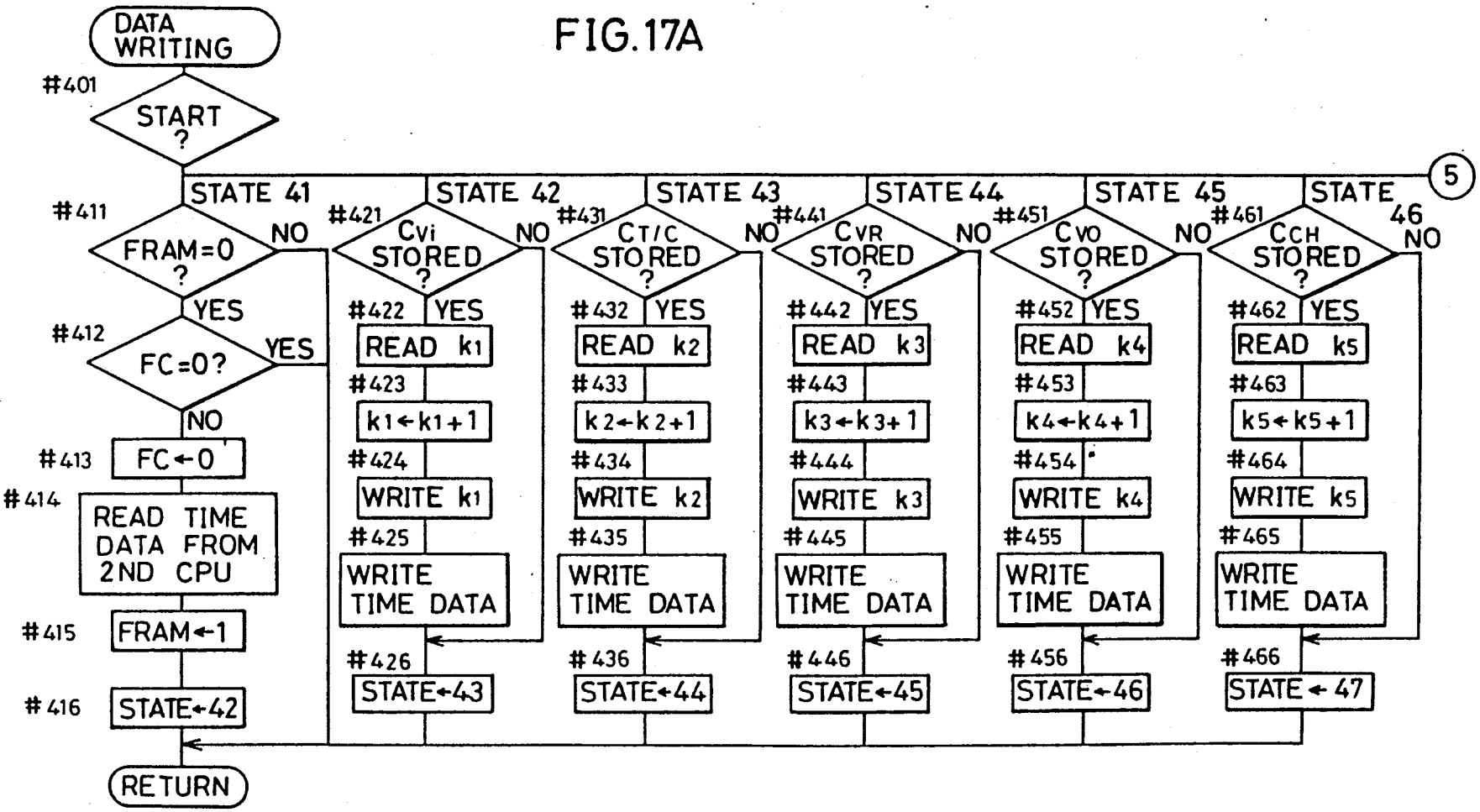
Figure 17B:
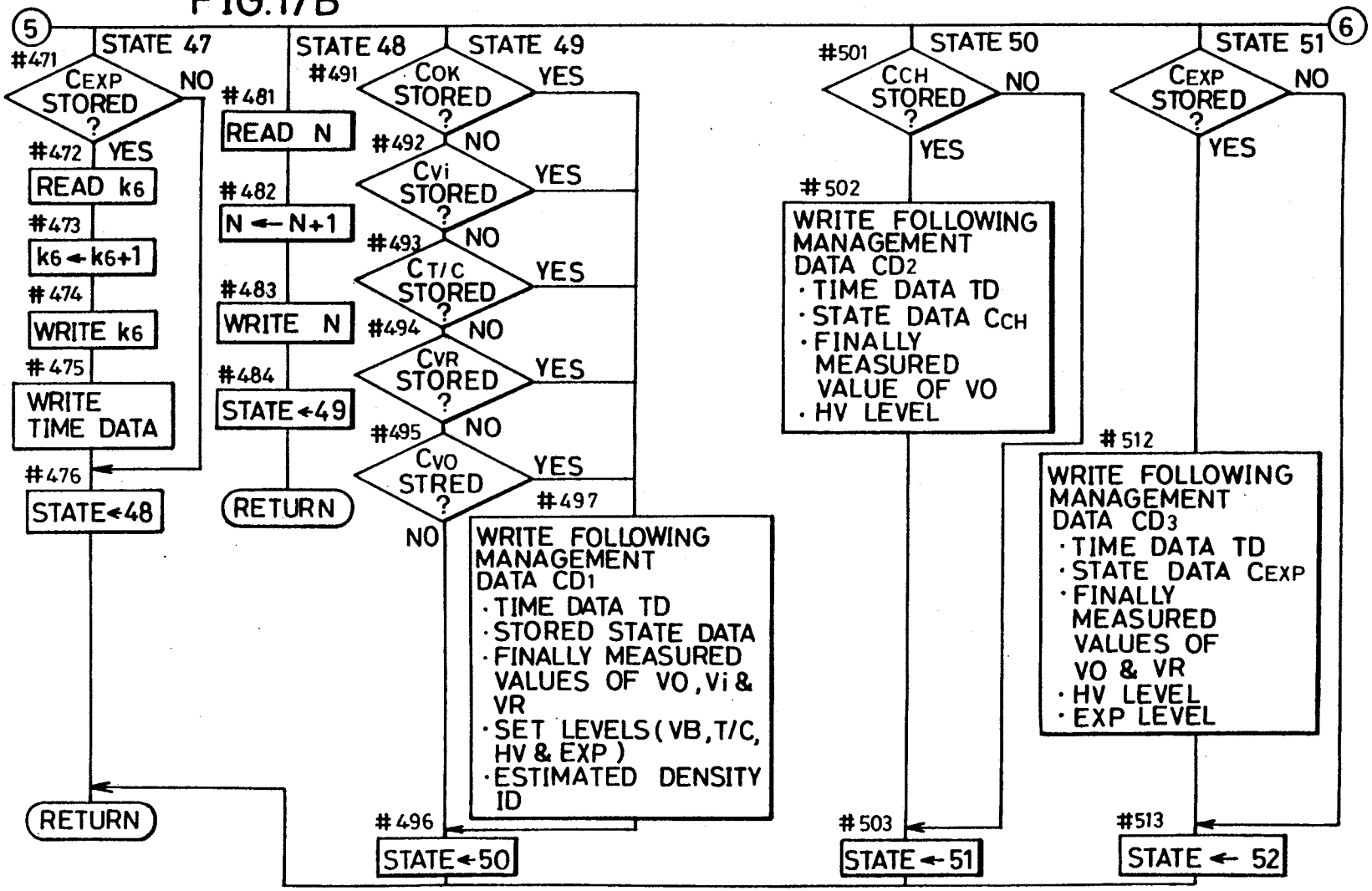
Figure 17C:
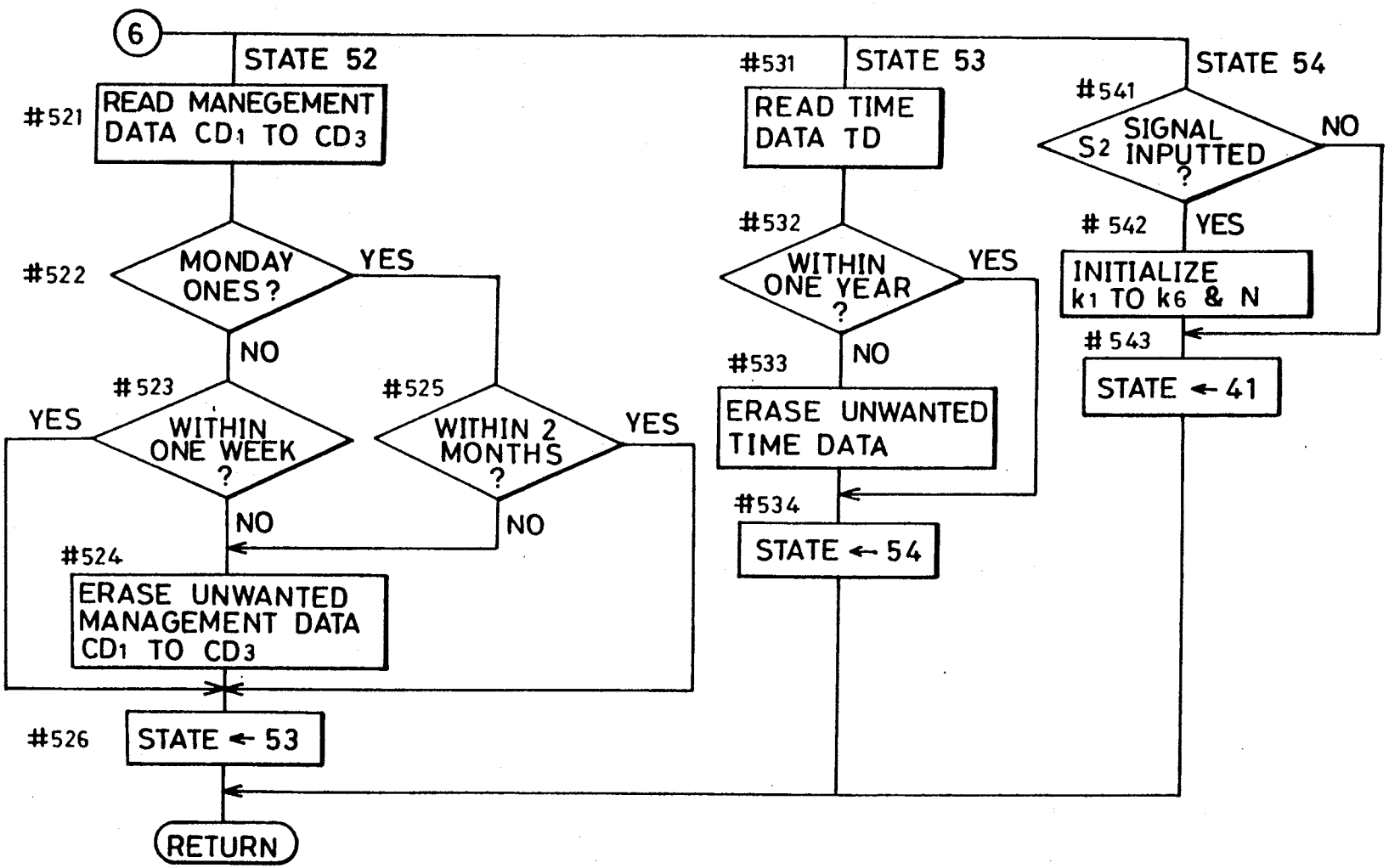
Figure 18A:
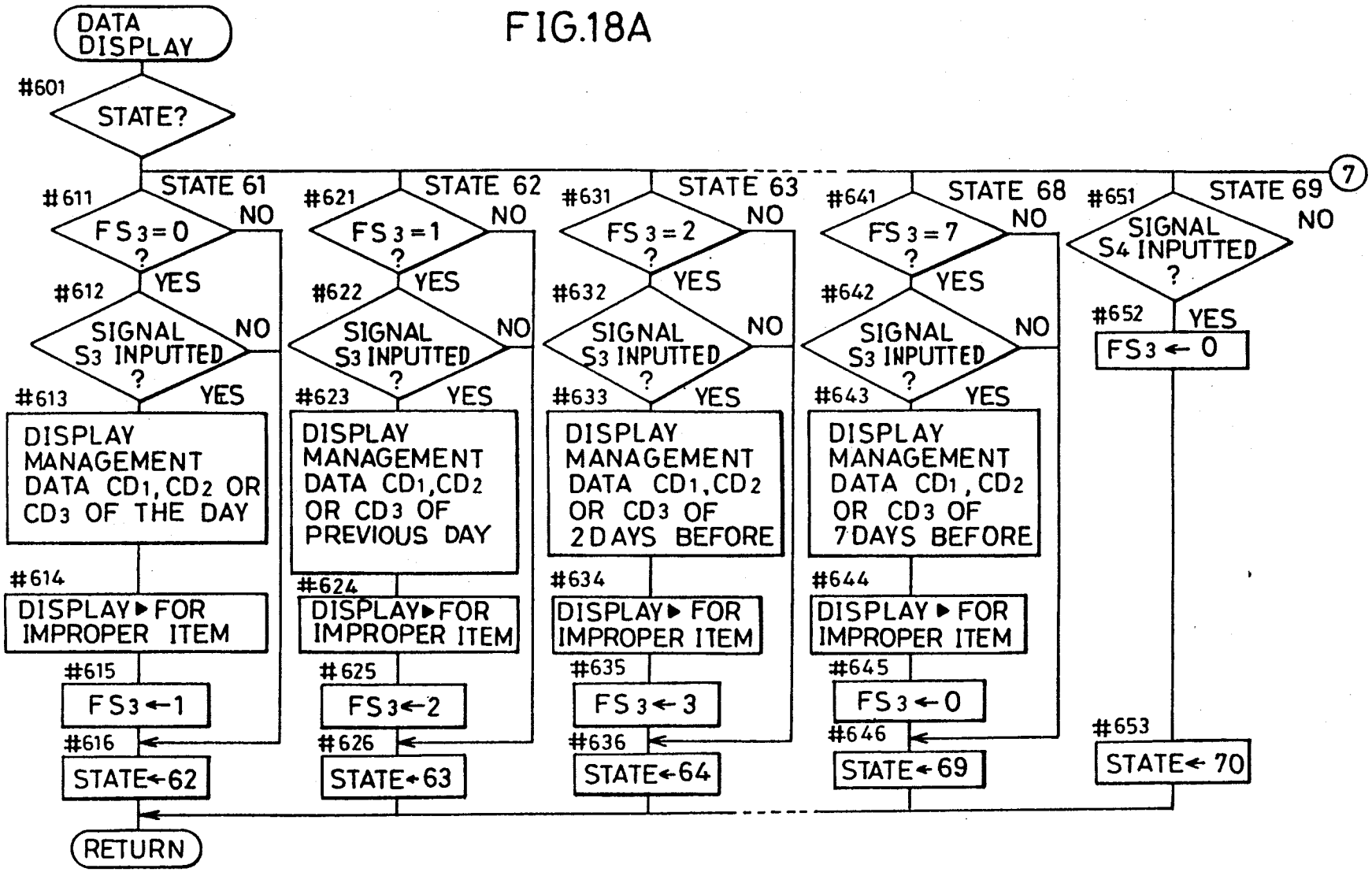
Figure 18B:
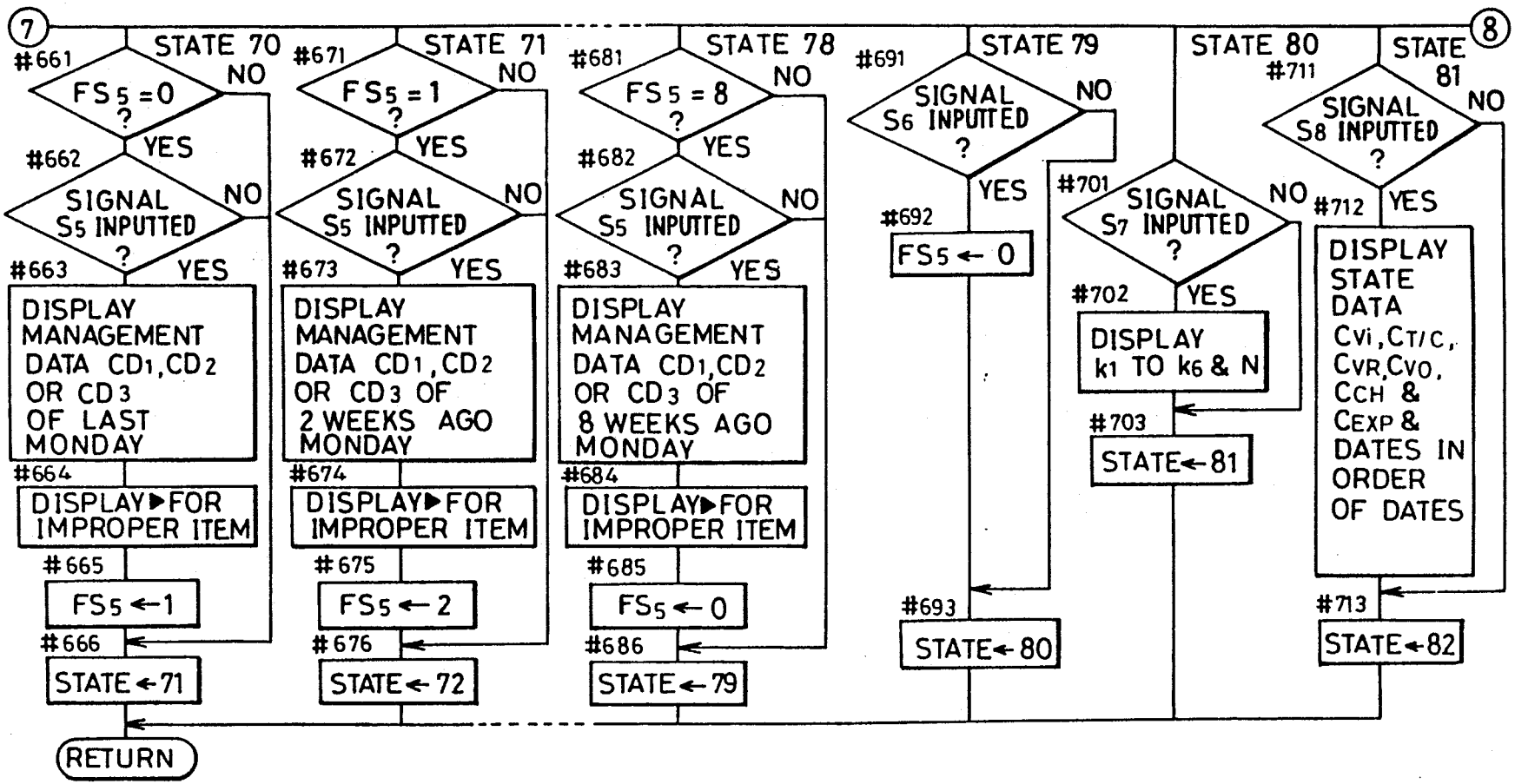
Figure 18C:
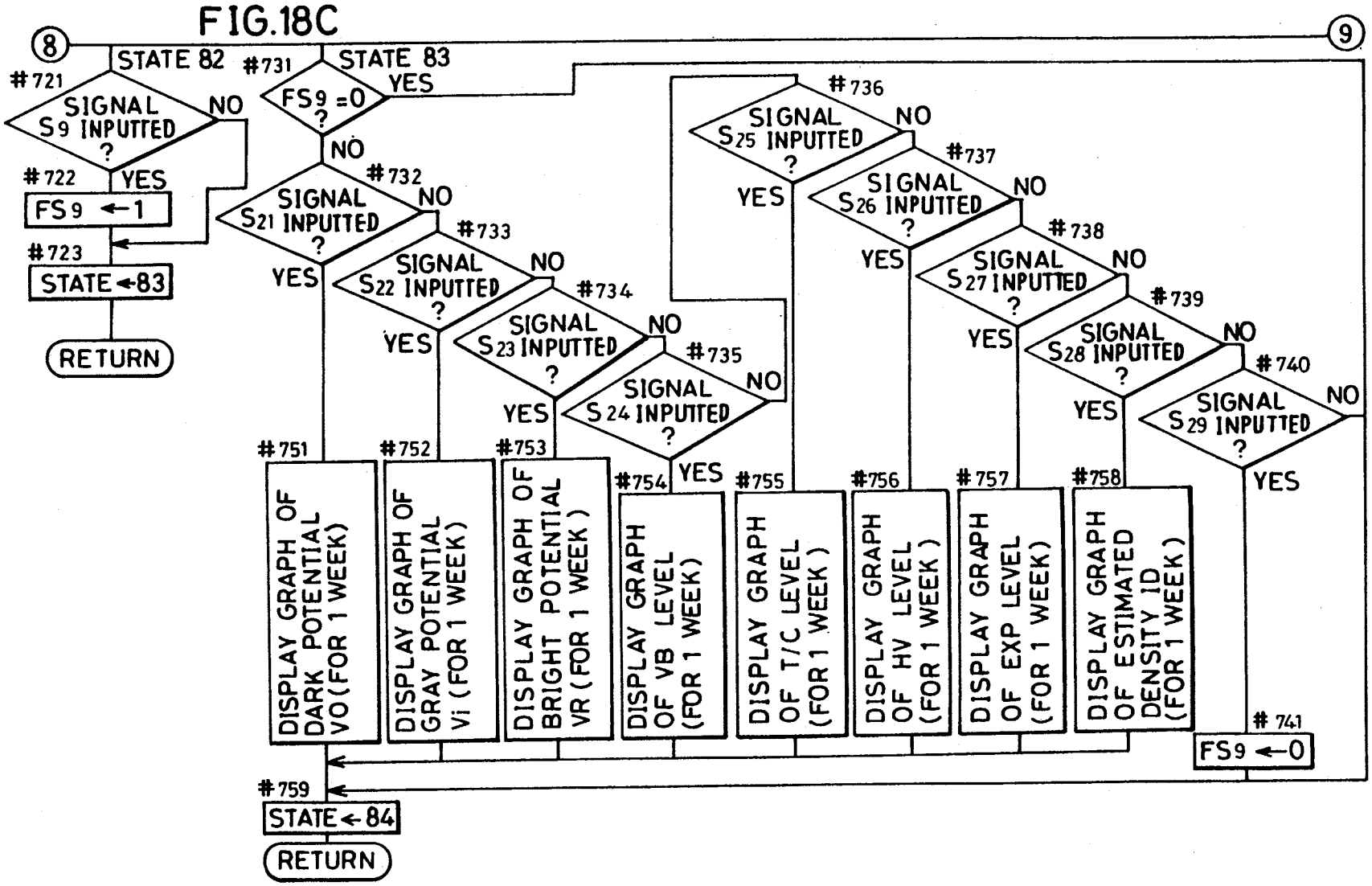
Figure 18D:
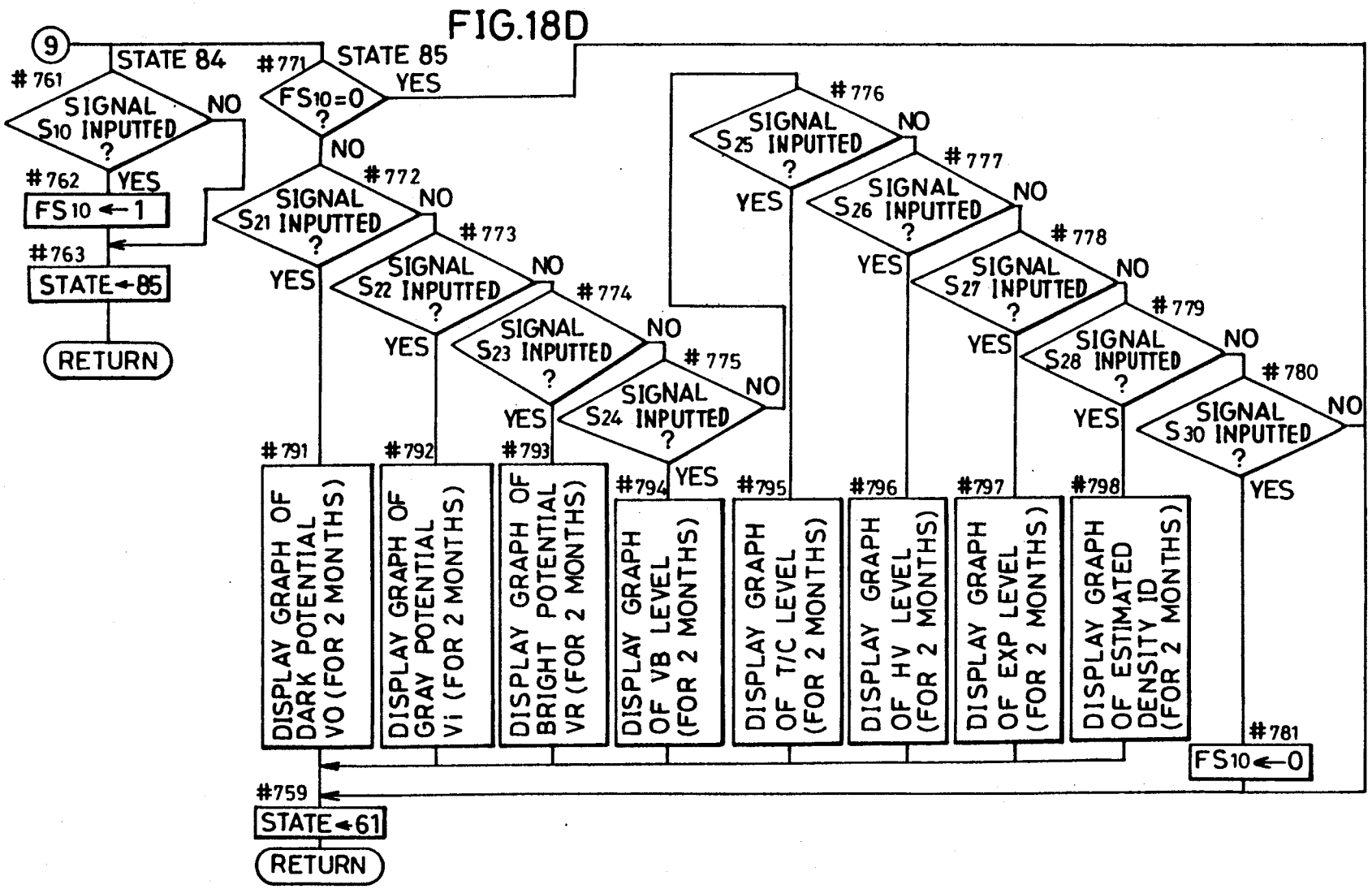

FIGS. 17A to 17C are flow charts of data writing processing at the step #6 in FIG. 14.

The state is checked at a step #401, to execute the following processing in response to the state:

In a state "41", a determination is made at a step #411 as to whether or not a writing termination flag FRAM indicating termination of this routine is "0". If the determination at the step #411 is of no, i.e., if the writing termination flag FRAM is "1", the processing is immediately returned to the main routine. This step #411 is so executed that each of processes following thereto is executed only once after the aforementioned image adjustment.

If the determination at the step #411 is of yes, a determination is made at a step #412 as to whether or not the image adjustment termination flag FC is "0".

If the determination at the step #412 is of no, i.e., if the image adjustment termination flag FC is "1", the flag FC is changed to "0" at a step #413 and the processing is advanced to a step #414.

Time data D indicating time information such as the date and the day of the week are read from the second CPU 221 at the step #414. Thereafter the writing termination flag FRAM is changed to "1" (step #415), and the state is upgraded to "42" (step #416).

In the state "42", a dteermination is made at a step #421 as to whether or not the state data $C_{Vi}$ is stored in the RAM 209.

If the determination at the step #421 is of yes, number data k1 showing the number of writing of the time data TD in the RAM 210 in response to the improper state of the gray potential Vi as described later is read from the RAM 210 at a step #422.

Then, "1" is added to the value of the read number data k1 to obtain new number data k1 (step #423), which in turn is written in the RAM 210.

Then, the time data TD read at the above step #424 are written in the RAM 210 in mapping with the state data $C_{Vi}$ at a step #425, and the state is updated to "43" at a step #426.

In states "43" to "47", processes similar to that in the state "42" are performed in correspondence to the state data $C_{T/C}$, $C_{VR}$, $C_{VO}$, $C_{CH}$ and $C_{EXP}$ respectively.

Namely, executed are determinations as to whether or not the state data $C_{T/C}$, $C_{VR}$, $C_{VO}$, $C_{CH}$ and $C_{EXP}$ are stored in the RAM 209 (steps #431, #441, #451, #461 and #471), reading of number data k2 to k6 (steps #432, #442, #452, #462 and #472), updating of the number data k2 to k6 (steps #433, #443, #453, #463 and #473), writing of the number data k2 to k6 (steps #434, #444, #454, #464 and #474), writing of the time data (steps #435, #445, #455, #465 and #475) and updating of the state (steps #436, #446, #456, #466 and #476).

In a state "48", processing number data N indicating the number of execution of image adjustment is read from the RAM 210 (step #481), "1" is added to the processing number data N to update its value (step #482), the updated processing number data is written in the RAM 210 (step #483), and the state is upgraded to "49" (step #484).

In the state "49", determinations are made as to whether or not the state data $C_{OK}$, $C_{Vi}$, $C_{T/C}$, $C_{VR}$ and $C_{VO}$ are stored in the RAM 209 at steps #491 to #495 respectively. If no state data are stored, the state is upgraded to "50" at a step #496.

If a determination of yes is made at any of the steps #491 to #495, management data CD1 for confirming time change of the operating state of the copying apparatus A are written in the RAM 210 at a step #497.

The management data CD1 comprise the time data TD, the state data determined as yes at the steps #491 to #495, finally measured values of three types of surface potentials VH (the dark potential VO, the gray potential Vi and the bright potential VR) measured after termination of the image adjustment, the respective set levels (VB, T/C, HV and EXP) and the estimated density data $ID_O$, $ID_i$ and $ID_R$.

In the state "50", a determination is made as to whether or not the state data $C_{CH}$ is stored (step #501), to write management data CD2 in the RAM 210 (step #502) if the determination is of yes, and the state is upgraded to "51".

The management data CD2 comprise the time data TD, the state data $C_{CH}$, the finally measured value of the dark potential VO evaluated after termination of the image adjustment and the HV levels.

In the state "51", a determination is made as to whether or not the state data $C_{EXP}$ is stored in the RAM 209 (step #511), to write management data CD3 in the RAM 210 (step #512) if the determination is of yes, and the state is upgraded to "52" (step #513).

The management data CD3 comprise the time data TD, the state data $C_{EXP}$, the finally measured values of the dark potential VO and the bright potential VR evaluated after termination of the image adjustment, the HV levels and the EXP levels.

Thus, items of contents of the management data CD1 to CD3 are varied with the cause for the improper state, i.e., depend on what is improper, to have the minimum information enabling identification of the cause for the improper operating state of the copying apparatus A. Thus, enabled are reduction in capacity of the RAM 210, simplification of the display as described later, and improvement in efficiency of data transmission to the management unit 227.

In states "52" to "54", periodic data erasing for improving usage efficiency of the memory of the RAM 210 or processing related to initialization of data is executed.

In the state "52", the previously written management data CD1 to CD3 are read from the RAM 210 at a step #521.

Then, a determination is made at a step #522 as to whether or not the read management data CD1 to D3 are written on a specific day of the week such as Monday, for example (hereinafter referred to as "Monday ones" and so forth).

If the determination at the step #522 is of yes, a determination is made at a step #525 as to whether or not the data are those within the past two months. If the determination at the step #525 is of yes, no data erasing is performed but the state is updated at a step #526.

If the determination at the step #522 is of no, on the other hand, a determination is made at a step #523 as to whether or not the data are those within the past one week. If the determination at the step #523 is of yes, the processing is advanced to the step #526.

If the determination at the step #523 or #525 is of no, unwanted management data CD1 to CD3 are erased at the step #524.

Thus, only daily ones within the past one week and every Monday ones within the past two months are continuously stored in the RAM 210.

In the state "53", the time data TD written in mapping with the respective state data in the aforementioned states "42" to "47" are read from the RAM 210.

Then, a determination is made at a step #532 as to whether or not the data are those within the past one year. If the determination at the step #532 is of yes, no data erasing is performed but the state is updated at a step #534.

If the determination at the step #532 is of no, on the other hand, unwanted time data TD are erased at a step #533.

Thus, only the time data TD within the past one year are continuously stored in the RAM 210.

In a state "54", a determination is made at a step #541 as to whether or not a signal S2 is inputted.

The signal S2 is inputted in the first CPU 201 when the serviceman key 118 is pressed and the initialization control signal S2 is applied from the management unit 227 to the copying apparatus A.

If the determination at the step #541 is of no, the state is returned to "41" at a step #543.

If the determination at the step #541 is of no, on the other hand, the values of the number data K1 to k6 and the processing number data N are initialized to "0" at a step #542, and the processing is advanced to the step #543.

FIGS. 18A to 18D are flow charts of data display processing at the step #7 in FIG. 14.

The state is first checked at a step #601, to execute the following processing in response to the state:

In a state "61", a determination is made at a step #611 as to whether or not a processing flag FS3 indicating the progress of execution of this routine is "0".

If the determination at the step #611 is of no, the processing is advanced to a step #616 to update the state to "62", while the processing is advanced to a step #612 if the determination is of yes.

At the step #612, a determination is made as to whether or not a signal S3 is inputted. The signal S3 is inputted in the first CPU 201 when the serviceman key 119 is pressed.

If the determination at the step #612 is of yes, the processing is advanced to a step #613, while the processing is shifted to the aforementioned step #616 if the determination is of no.

At the step #613, data of the day (day of execution of this routine) are read from the management data CD1 to CD3 stored in the RAM 210, and displayed on the message display portion 117.

Figure 22D:
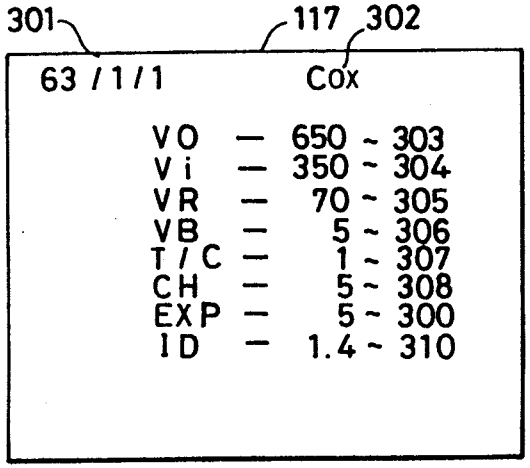
Figure 22E:
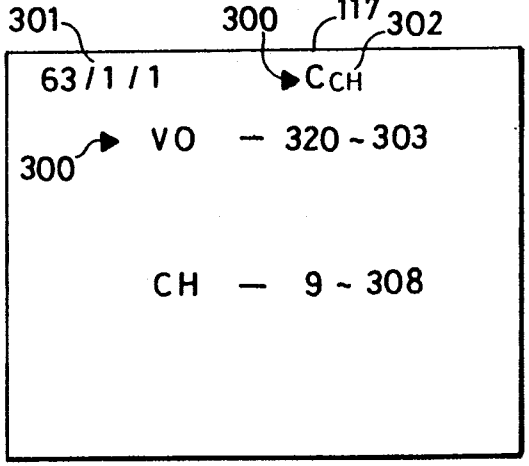
Figure 22F:
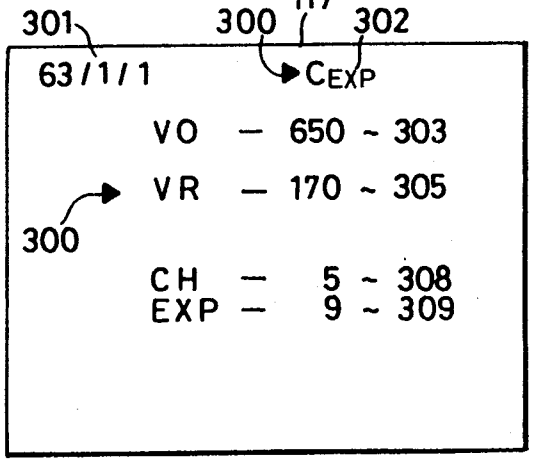
Figures 22G, 22H, 22J, 22K, 221:
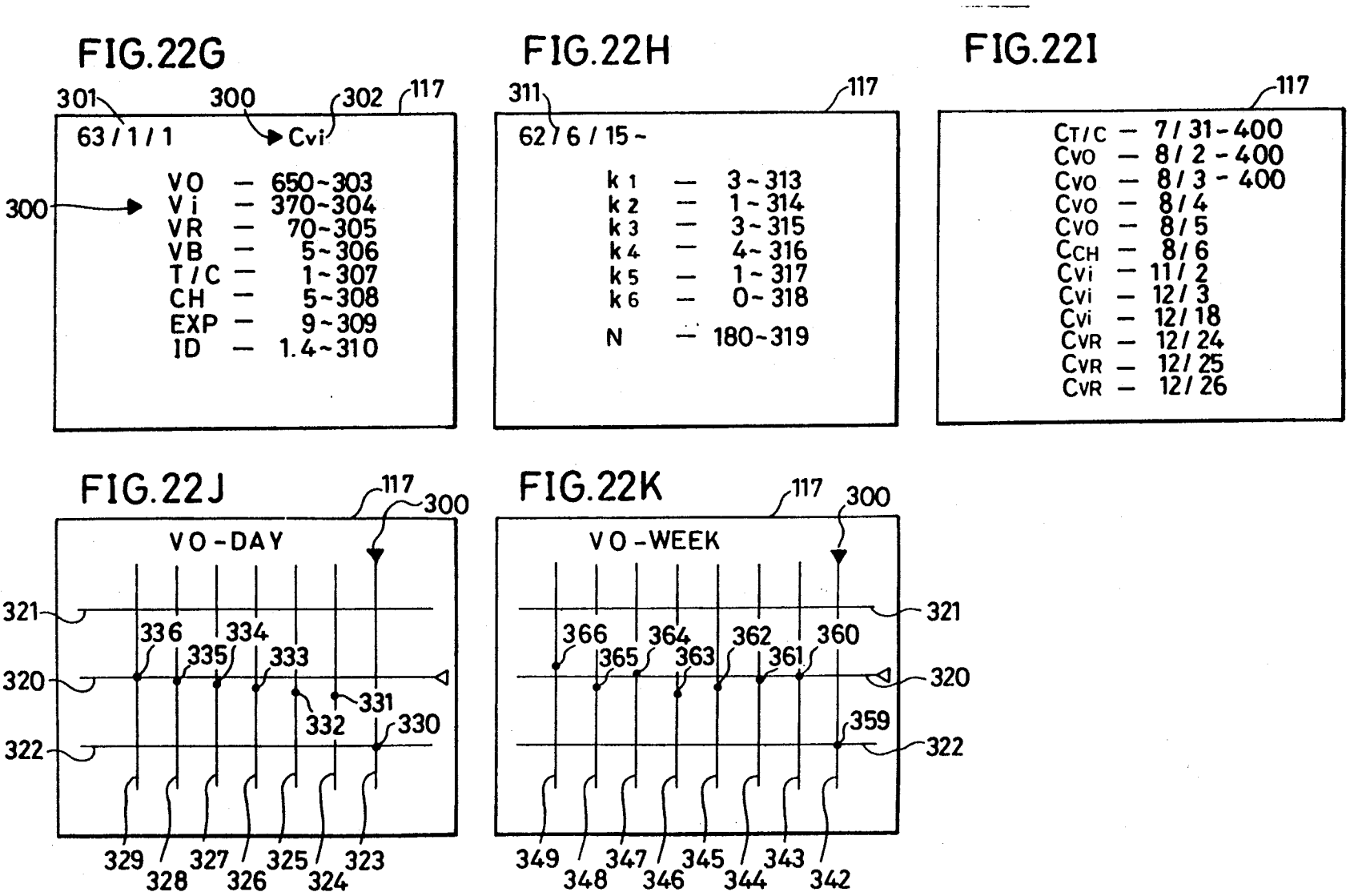

FIGS. 22D and 22G illustrate screens displayed on the basis of the management data CD1 corresponding to proper and improper states respectively, and FIGS. 22E and 22F illustrate screens displayed on the basis of the management data CD2 and CD3 respectively. In these figures, numeral 301 denote dates, numeral 302 denote characters corresponding to the state data, numerals 303 to 305 denote respective finally measured values, numerals 306 to 309 denote respective set level values, and numeral 310 denotes estimated density values.

At a step #614, identification marks 300 such as black triangles in FIGS. 22E to 22G, for example, are displayed in the vicinity of display characters corresponding to improper items in the display screens. Thus, it is easy to confirm whether the respective items are proper or improper.

At a step #615, the processing flag FS3 is changed to "1".

In states "62" to "68", determinations are made as to the value of the processing flag FS3 and as to whether or not the signal S3 is inputted, similarly to the state "61". Further, the ones of the previous day, two days before, three days before, . . . six days before and seven days before are read from the management data CD1 to CD3 and displayed, so that the identification marks 300 are put on improper items.

That is, the displayed management data CD1 to CD3 are backwardly replaced at a daily pace every time the serviceman presses the serviceman key 119. If the key 119 is pressed when those of seven days before are displayed, the data of the day appear again.

In a state "69", a determination is made at a step #651 as to whether or not a signal S4 is inputted.

The signal S4 is inputted when the clear/stop key 103 or any one of the serviceman keys 118 and 120 to 124 excluding the key 119 is pressed.

If the determination at the step #651 is of yes, the processing flag FS3 is returned to "0" at a step #652.

Thus, display of the management data CD1 to CD3 can be stopped by pressing the clear/stop key 103, for example. If the clear/stop key 103 is pressed and then the serviceman key 119 is pressed, the data of two to seven days before can immediately be replaced by those of the day.

In a state "70", a determination is made at a step #661 as to whether or not a processing flag FS5 is "0".

If the determination at the step #661 is of no, the processing is shifted to a step #666 to update the state to "71", while the processing is advanced to a step #662 if the determination is of yes.

At the step #662, a determination is made as to whether or not a signal S5 is inputted. The signal S5 is inputted when the serviceman key 120 is pressed. If the determination at the step #662 is of yes, the processing is advanced to a step #663, while the processing is shifted to the aforementioned step #666 if the determination is of no.

At the step #663, data of last Monday are read from the management data CD1 to CD3 stored in the RAM 210 and displayed on the message display portion 117.

Then, the aforementioned identification marks 300 are displayed in the vicinity of display characters corresponding to improper items in the display screen at a step #664.

At a step #665, the processing flag FS5 is updated to "1".

In states "71" to "78", determinations are made as to the value of the processing flag FS5 and as to whether or not the signal S5 is inputted similarly to the state "70". Data of last Monday, two weeks ago Monday, . . . , and eight weeks ago Monday are read from the management data CD1 to CD3 respectively and displayed, while the identification marks 300 are put to improper items.

That is, the displayed management data CD1 to CD3 are backwardly replaced at a weekly pace every time the serviceman presses the serviceman key 120. If the key 120 is pressed when those of eight weeks ago Monday are displayed, the data of last Monday appear again.

In a state "79", a determination is made at a step #691 as to whether or not a signal S6 is inputted.

The signal S6 is inputted when the clear/stop key 103 or any one of the serviceman keys 118, 119 and 121 to 124 excluding the key 120 is pressed. If the determination at the step #691 is of yes, the processing flag FS5 is returned to "0" at a step #692. Thus, display of the management data CD1 to CD3 can be stopped by pressing the clear/stop key 103, for example.

In a state "80", a determination is made at a step #701 as to whether or not a signal S7 is inputted. The signal S7 is inputted when the serviceman key 121 is pressed. If the determination at the step #701 is of no, the processing is shifted to a step #703 to update the state, while the processing is advanced to a step #702 if the determination is of yes.

At the step #702, the number data k1 to k6 and the processing number data N are read from the RAM 210, and the read data are displayed on the message display portion 117.

FIG. 22H shows a display screen in the processing at the step #702. Referring to FIG. 22H, numerals 313 to 319 denote values of the number data k1 to k6 and the processing number data N respectively. Numeral 311 denotes the date of starting counting of the data k1 to k6 and N after initialization thereof.

In a state "81", a determination is made at a step #771 as to whether or not a signal S8 is inputted. The signal S8 is inputted when the serviceman key 122 is pressed. If the determination at the step #771 is of no, the processing is shifted to a step #713 to update the state, while the processing is advanced to a step #712 if the determination is of yes.

At the step #712, the state data $C_{Vi}$, $C_{T/C}$, $C_{VR}$, $C_{VO}$, $C_{CH}$ and $C_{EXP}$ corresponding to improper and abnormal states and the dates of storage of these data are displayed in order of the dates. FIG. 22I shows a display screen in the processing at the step #712, and numeral 400 denotes the dates of storage of the respective state data.

In a state "82", a determination is made at a step #721 as to whether or not a signal S9 is inputted. The signal S9 is inputted when the serviceman key 123 is pressed If the determination at the step #721 is of no, the processing is shifted to a step #723 to update the state, while the processing is advanced to a step #722 if the determination is of yes. A processing flag FS9 is set at "1" at the step #722.

In a state "83", a determination is made at a step #731 as to whether or not the processing flag FS9 is "0", and the processing is advanced to a step #759 to update the state if the determination is of yes.

If the determination at the step #731 is of no, i.e., if the serviceman key 123 is pressed, determinations are successively made at steps #732 to #739 as to whether or not signals S21 to S28 are inputted. The signals S21 to S28 are inputted in response to manipulations of the ten keys 104 to 111.

If the determinations at the steps #732 to #739 are of yes, the processing is advanced to steps #751 to #758 respectively.

At the steps #751 to #758, the daily values of the dark potential VO, the gray potential Vi, the bright potential VR, the VB levels, the T/C levels, the HV levels, the EXP levels and the estimated density ID of the past seven days are graphed (schematized) in a time-series manner and displayed on the message display portion 117. Thus, the serviceman can confirm change of the operating states in the past seven days every item of self diagnosis.

FIG. 22J illustrates a display screen at the step #751. Referring to FIG. 22J, numeral 320 denotes a horizontal line showing the optimum value of the dark potential VO, numerals 321 and 322 denote horizontal lines showing upper and lower limits of the proper range, numerals 323 to 329 denote vertical lines showing days (the day, the previous day, . . . , and six days before), and numerals 330 to 336 denote plots showing the daily values of the dark potential VO. In the example shown in FIG. 22J, the value of the dark potential VO is optimum six days before, and then gradually reduced to be below the lower limit on the day. Therefore, the identification mark 300 is displayed on the vertical line 323.

If all determinations at the steps #732 to #739 are of no, a determination is made at a step #740 as to whether or not a signal S29 is inputted. The signal S29 is inputted when the clear/stop key 103 and any one of the serviceman keys 118 to 122 and 124 excluding the key 123 are pressed.

If the determination at the step #740 is of yes, the processing flag FS9 is reset to "0" at a step #741, and the processing is shifted to the aforementioned step #759.

In a state "84", a determination is made at a step #761 as to whether or not a signal S10 is inputted. The signal S10 is inputted when the serviceman key 124 is pressed. If the determination at the step #761 is of no, the processing is returned to the main routine.

If the determination at the step #761 is of yes, on the other hand, the processing flag FS10 is changed to "1" at a step #762, and the state is updated to "85" at a step #763.

In the sate "85", a determination is made at a step #771 as to whether or not the processing flag FS10 is "0", and the processing is advanced to a step #799 to return the state to "61" if the determination is of yes.

If the determination at the step #771 is of no, i.e., of the serviceman key 124 is pressed, determinations are successively made at steps #772 to #779 as to whether or not the signals S21 to S28 are inputted, similarly to the state "83".

If the determination at the steps #772 to #779 are of yes, the processing is advanced to steps #791 to #798 respectively.

At the steps #791 to #798, the values of the dark potential VO, the gray potential Vi, the bright potential VR, the VB levels, the T/C levels, the HV levels, the EXP levels and the estimated density ID on every Monday of the past two months are graphed in a time-series manner and displayed on the message display portion 117. Thus, the serviceman can confirm change of the operating states in the past two months (eight weeks) every item of self diagnosis.

FIG. 22K illustrates a display screen at the step #791. Referring to FIG. 22K, numerals 320 to 322 denote horizontal lines similar to those of FIG. 22J, numerals 342 to 349 denote vertical lines showing weeks (this week, last week, the week before last week, . . . ), and numerals 359 to 366 denote plots showing the weekly values of the dark potential VO.

If all determinations at the step #772 to #779 are of no, a determination is made at a step #780 as to whether or not a signal S30 is inputted, and the processing flag FS10 is reset to "0" at a step #781 so that the processing is shifted to the aforementioned step #799 if the determination is of yes. The signal S30 is inputted when the clear/stop key 103 and any one of the serviceman keys 118 to 123 excluding the key 124 are pressed.

Figure 19:
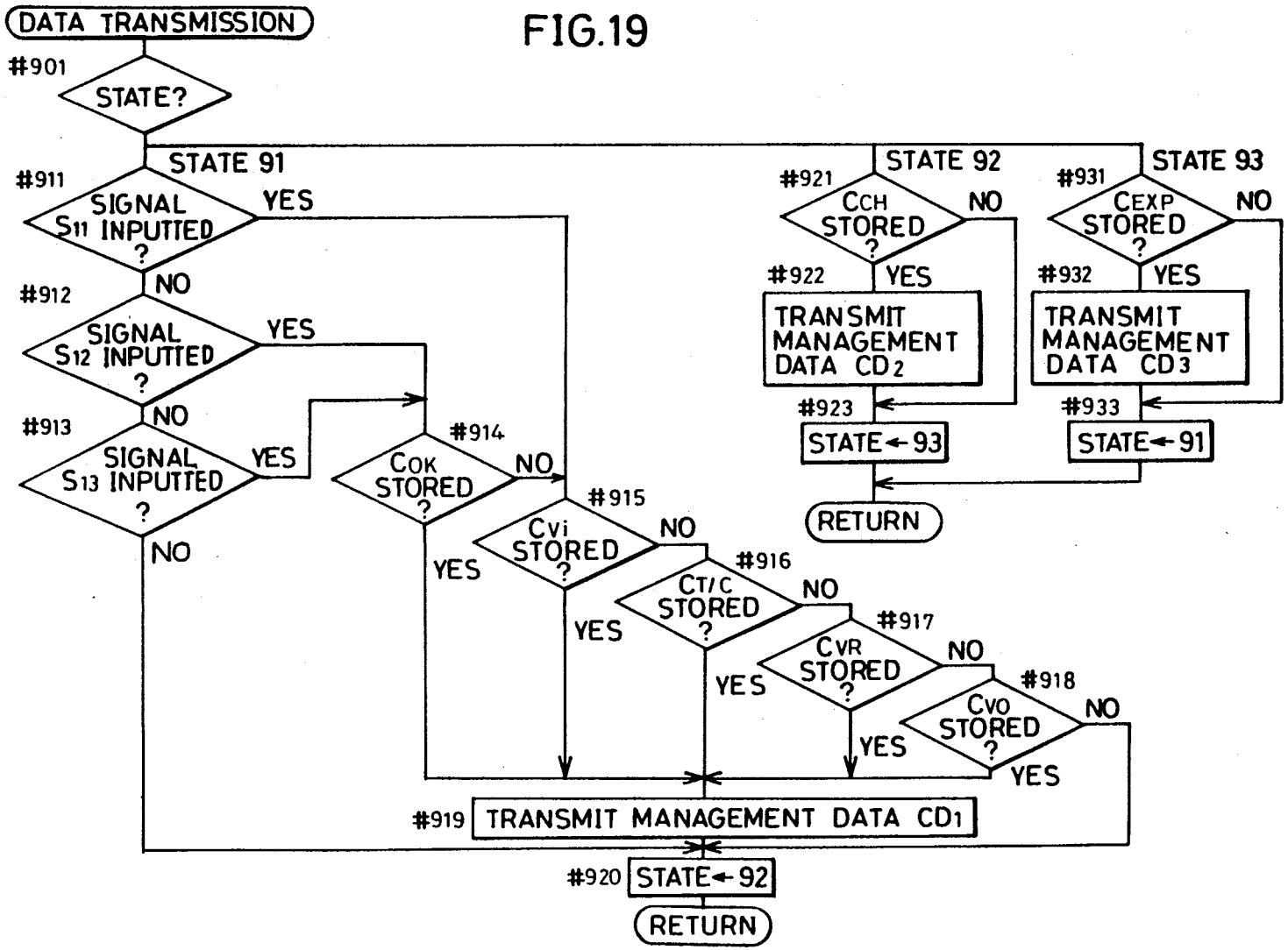

FIG. 19 is a flow chart showing data transmission processing at the step #8 in FIG. 14.

In this routine, corresponding management information is transferred to the management unit 227 every item of self diagnosis at predetermined time in response to necessity in management of the operating state of the copying apparatus A.

The state is first checked at a step #901, to execute the following processing in response to the state.

In a state "91", determinations are successively made at steps #911 to #913 as to whether or not signals S11 to S13 are inputted, in order to confirm whether or not this is the time (the day of the week, the time) for transmitting the data. The signals S11 and S12 are inputted from the second CPU 221 at predetermined time as hereinafter described, while the signal S13 is inputted when the management unit 227 applies a control signal indicating data transmission.

If the determination at the step #911 is of yes, the processing is advanced to a step #915, while the processing is advanced to a step #914 if the determination at the step #911 is of no and that at the step #912 is of yes.

If the determination at the step #913 is of no, i.e., if none of the signals S11 to S13 is inputted, the processing is shifted to a step #920 to update the state.

At the steps #914 to #918, the results of self diagnosis as to the respective items are determined. In other words, determinations are made as to whether or not the state data $C_{OK}$, $C_{VI}$, $C_{T/C}$, $C_{VR}$ and $C_{VO}$ corresponding to proper and improper states are stored. If a determination of yes is made at any one of the steps #914 to #918, the processing is advanced to a step #919, while the processing is shifted to a step #920 if all determinations are of no.

At the step #919, the aforementioned management data CD1 are transmitted to the management unit 227 through the online controller 223.

Namely, the state "91" is so executed that management information is transferred to the management unit 227 at 10 a.m. every day regardless of the day of the week if there is any improper item, while the management information is transmitted at 10 a.m. every Monday and every Thursday if there is no improper item.

In a state "92", a determination is made at a step #921 as to whether or not the state data $C_{CH}$ is stored to update the state (step #923) if the determination is of no, and the processing is returned to the main routine. If the determination at the step #921 is of yes, on the other hand, the management data CD2 are transmitted to the management unit 227 at a step #923.

In the state "93", a determination is made at a step #931 as to whether or not the state data $C_{EXP}$ is stored to update the state (step #933) if the determination is of no, and the processing is returned to the main routine. If the determination at the step #931 is of yes, on the other hand, the management data CD3 are transmitted to the management unit 227 at the step #923.

Namely, the states "92" and "93" are adapted to cope with an abnormal state, so that data indicating the content of the abnormal state are transmitted to the management unit 227 in the abnormal state regardless of the data and presence/absence of indication from the management unit 227. Thus, quick maintenance operation is executed to reduce down-time (fault time) of the copying apparatus A.

Figure 20:
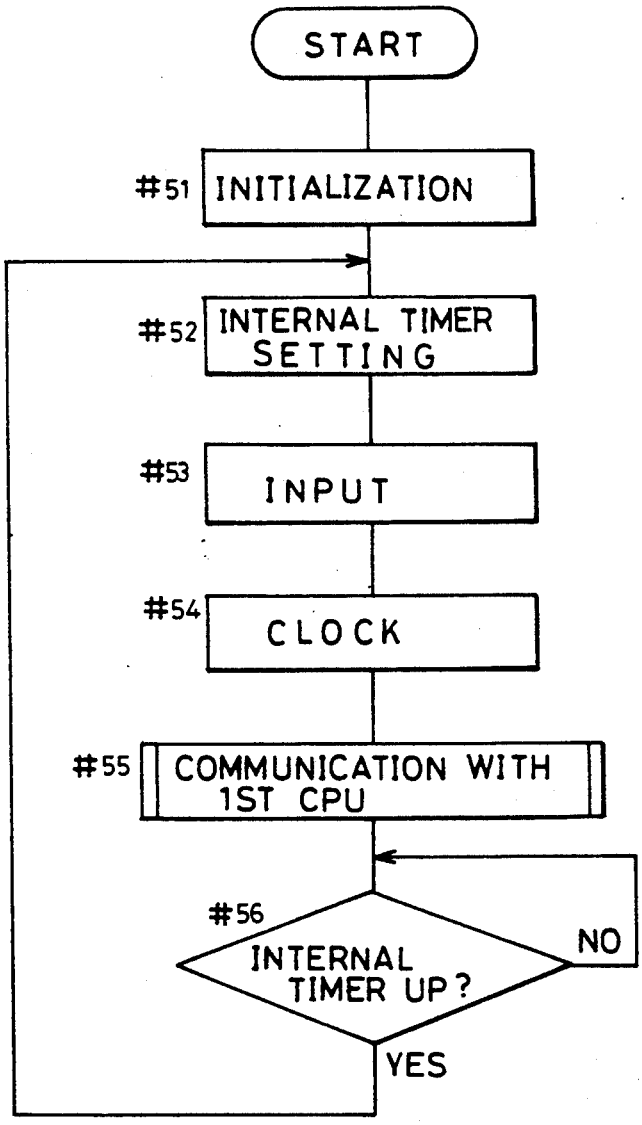

FIG. 20 is a main flow chart schematically showing the operation of the second CPU 221.

When the program is started, initialization of the respective parts (step #51), setting of the internal timer (step #52), input processing (step #53) and counting processing (step #54) are successively carried out and thereafter communication with the first CPU 201 is executed at a step #55. After these processes, queuing for the internal timer is performed at a step #56, and the processing is returned to the step #52. The second CPU 221 is backed up by a battery, so that its clock function is maintained even if the power for the body is turned off.

Figure 21:
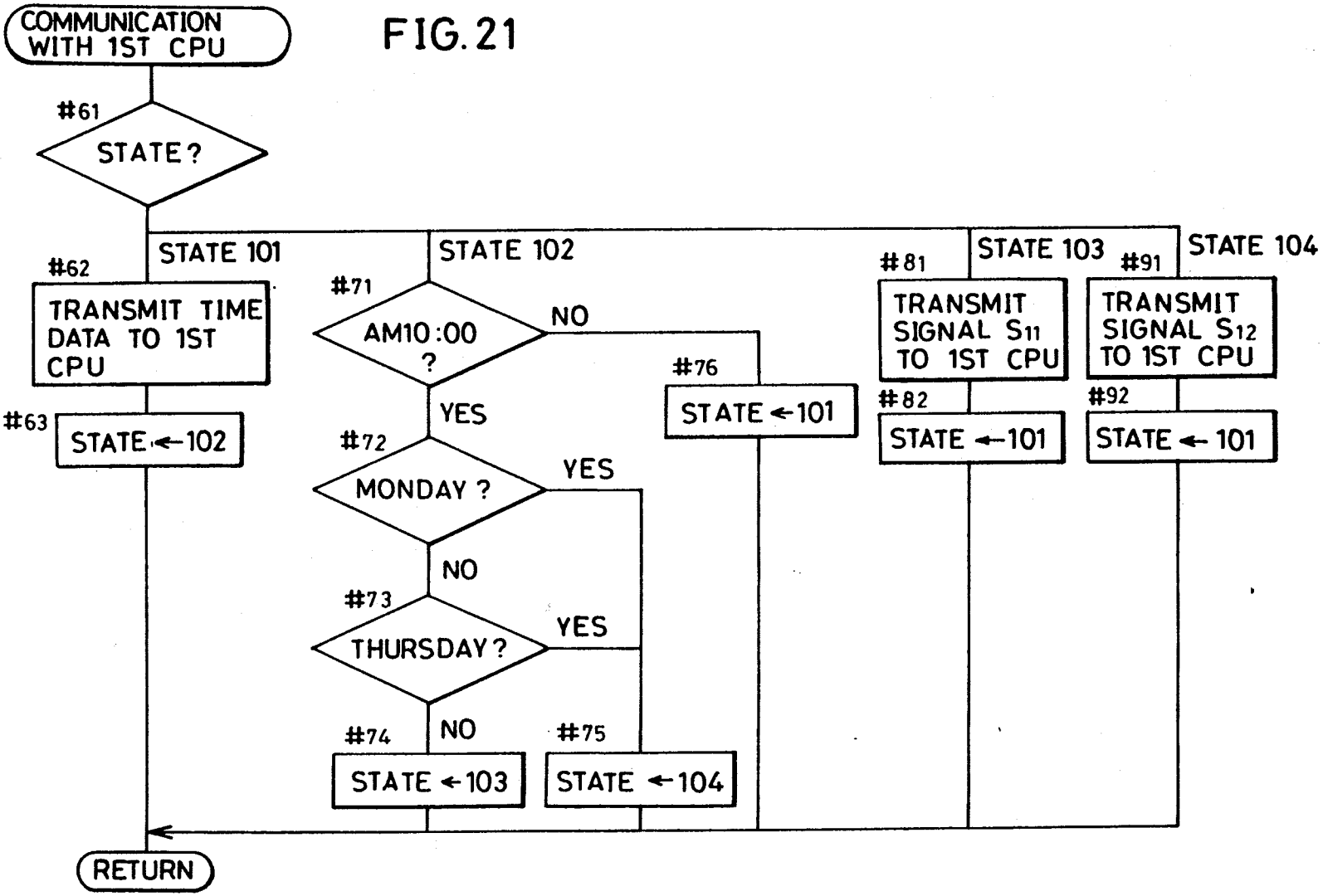

FIG. 21 is a flow chart showing communication with the first CPU 201 at the aforementioned step #55.

In this routine, the state is first checked at a step #61, to execute the following processing in response to the state:

In a state "101", time data TD indicating the current date, the day of the week and the time are transmitted at a step #62, and the state is upgraded to "102" at a step #63.

In the state "102", a determination is made at a step #71 as to whether or not it is 10 a.m. (AM10:00), for example, at present, and the state is returned to "101" at a step #76 if the determination is of no.

If the determination at the step #71 is of yes, i.e., if it is 10 a.m., a determination is made at a step #72 as to whether or not it is Monday. If it is not Monday, a determination is made at a step #73 as to whether or not it is Thursday. If it is Monday or Thursday, the state is upgraded to "104" (step #75), while the state is changed to "103" if it is another day of the week (step #74).

In the state "103", a signal S11 is transmitted to the first CPU 201 at a step #81. Namely, the signal S11 is transmitted on a day other than Monday and Thursday. After execution of the step #81, the state is returned to "101" at a step #82.

In the state "104", a signal S12 is transmitted to the first CPU 201 at a step #91. Namely, the signal S12 is transmitted if it is Monday or Thursday. After execution of the step #91, the state is returned to "101" at a step #92.

In the aforementioned embodiment, the time for transmitting prescribed management information to the management unit 227 can be arbitrarily selected in response to the actual condition of management.

Although daily management data are stored in the fixed RAM 210 in the aforementioned embodiment, such management data may be stored in a storage medium, such as an IC card, for example, which can be attached to/detached from the copying apparatus A. In this case, it is possible to analyze the condition of the copying apparatus A using a dedicated data processing unit carried by the serviceman for maintenance.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a photoreceptor;

electrostatic latent image forming means for forming an electrostatic latent image on said photoreceptor;

developing means for developing said electrostatic latent image formed on said photoreceptor and forming a toner image;

transfer means for transferring said toner image formed on said photoreceptor onto a recording paper;

measuring means for measuring density of said toner image formed on said photoreceptor and outputting a measured density data;

estimation means for estimating density of said image transferred onto said recording paper on the basis of said measured density data and outputting an estimated image density data; and display means for displaying said estimated image density data.

2. An image forming apparatus in accordance with claim 1, wherein said measuring means comprises:

a light emitting element for emitting light onto said photoreceptor, and a light receiving element for receiving light emitted from said light emitting element and reflected by said photoreceptor, and said estimation means estimates density of said image on said recording paper in response to output of said light receiving element.

3. An image forming apparatus in accordance with claim 1, further including:

mode selection means for selecting:

a first mode for estimating image density on said recording paper, and a second mode for forming an image on said recording paper, and control means for operating said latent image forming means, said developing means, said measuring means and said estimation means while stopping operation of said transfer means when said first mode is selected and operating said latent image forming means, said developing means and said transfer means while stopping operation of said measuring means and said estimation means when said second mode is selected.

4. An image forming apparatus in accordance with claim 1, further including:

storage means for storing said estimated image density data, and calling means for calling said data stored in said storage means.

5. An image forming apparatus including:

a photoreceptor;

image forming means for forming an image on a recording paper through a plurality of processes;

measuring means for measuring an operating state of said image forming means before formation of said image on said recording paper and outputting a measured data;

estimation means for estimating density of said image formed on said recording paper on the basis of said measured data and outputting an estimated image density data; and display means for displaying said estimated image density data.

6. In an image forming apparatus for transferring a toner image formed on a photoreceptor onto a recording paper, an image forming method including the steps of:

forming an electrostatic latent image on a photoreceptor;

developing said electrostatic latent image formed on said photoreceptor thereby forming a toner image;

measuring density of said toner image formed on said photoreceptor;

estimating density of said image formed on said recording paper on the basis of said measured density; and displaying said estimated density.

7. An image forming method in accordance with claim 6, further including a step of inhibiting transfer of said toner image formed on said photoreceptor onto said recording paper.

8. An image forming method in accordance with claim 6, further including a step of storing said estimated density.

9. An image forming method in accordance with claim 8, further including a step of calling said stored density.

10. An image forming apparatus including:

image forming means capable of forming an image on a recording paper in various density levels;

manual density adjusting means having a manually operated switch for adjusting said image density in response to operation of said manually operated switch;

diagnostic means for diagnosing if said image forming means is in a first state being capable of forming a proper image, a second state being operable but incapable of forming said proper image, or an inoperable third state;

control means for allowing operation of said image forming means when said image forming means is in said first state and in said second state and inhibiting operation of said image forming means when the same is in said third state; and warning means for giving warning in said second state in response to operation of said manually operated switch.

11. An image forming apparatus in accordance with claim 10, wherein said image forming means comprises:

a photoreceptor, charging means for charging said photoreceptor, exposure means for exposing said photoreceptor, and developing means for sticking toner onto said photoreceptor, and said diagnostic means diagnoses said image forming means as being in said second state when said photoreceptor has a residual potential higher than a prescribed value.

12. An image forming apparatus in accordance with claim 10, wherein said image forming means comprises:

a photoreceptor, charging means for charging said photoreceptor, exposure means for exposing said photoreceptor, and developing means for sticking toner onto said photoreceptor, and said diagnostic means diagnoses said image forming means as being in said second state if the potential of said photoreceptor measured when said exposure means exposes a white original image, that measured when said exposure means exposes a gray original image and that measured when said exposure means makes no exposure are not in prescribed relation.

13. An image forming apparatus including:

input means for inputting image forming conditions;

image forming means for forming an image on a recording paper in accordance with said inputted image forming conditions;

diagnostic means for diagnosing if said image forming means is in a first state being capable of performing proper image forming operation, a second state being operable but incapable of performing said proper image forming operation or an inoperable third state;

control means for allowing operation of said image forming means in said first state and said second state, and inhibiting operation of said image forming means when the same is in said third state; and warning means for giving warning in response to input of said image forming conditions in said second state.

14. An image forming apparatus in accordance with claim 13, wherein said second state is inferior in image reproducibility to said first state.

15. An image forming apparatus including:

image forming means for forming an image on a recording paper;

diagnostic means for diagnosing whether said image forming means is in a first type of improper state or in a second type of improper state;

manual operation means; and display means for displaying said improper state of said image forming means in response to operation of said manual operation means when said image forming means is in said first type of improper state, and displaying said improper state of said image forming means regardless of operation of said manual operation means when said image forming means is in said second type of improper state.

16. An image forming apparatus in accordance with claim 15, further including:

control means for allowing image forming operation of said image forming means when the same is in said first type of improper state and inhibiting said image forming operation of said image forming means when the same is in said second type of improper state.

17. In an image forming apparatus including image forming means and a manually operated switch and being capable of forming an image on a recording paper in various density levels, an image forming method including the steps of:

diagnosing whether said image forming means is in a proper state being capable of forming a proper image or in an improper state being incapable of forming said proper image;

adjusting image density in response to operation of said manually operated switch; and displaying said improper state of said image forming means in response to operation of said manually operated switch when said image forming means is in said improper state.

18. In an image forming apparatus capable of forming an image on a recording paper in set conditions through image forming means, an image forming method including the steps of:

diagnosing whether said image forming means is in a proper state being capable of forming a proper image or an improper state being incapable of forming said proper image;

inputting said image forming conditions; and displaying said improper state of said image forming means in response to input of said image forming conditions when said image forming means is in said improper state.

19. In an image forming apparatus including image forming means and manual operation means for forming an image on a recording paper, an image forming method including the steps of:

diagnosing whether said image forming means is in a first type of improper state or a second type of improper state;

displaying said improper state of said image forming means in response to operation of said manual operation means when said image forming means is in said first type of improper state; and displaying said improper state of said image forming means regardless of operation of said manual operation means when said image forming means is in said second type of improper state.

20. An image forming apparatus including:

image forming means for forming an image on a recording paper;

monitor means for monitoring the operating state of said image forming means;

diagnostic means for detecting an improper portion of said image forming means on the basis of the result of monitoring of said monitor means and judging whether the detected improper portion causes a first type of improper state or a second type of improper state; and storage means for storing said detected improper portion and the type of said improper state caused by the detected improper portion.

21. An image forming apparatus in accordance with claim 20, further including:

manual operation means, and display means for displaying the content stored in said storage means in response to said manual operation means.

22. In an image forming apparatus for forming an image on a recording paper using image forming means, an image forming method including the steps of:

monitoring the operating state of said image forming means;

detecting an improper portion of said image forming means on the basis of the result of said monitoring and judging whether it causes a first type of improper state or a second type of improper state; and storing said detected improper portion and the type of said improper state caused by the same.

23. An image forming method in accordance with claim 22, further including the steps of:

inputting a display command, and displaying said stored content in response to said display command.

24. An image forming apparatus including:

image forming means for forming an image on a recording paper;

diagnostic means for diagnosing the operating state of said image forming means and outputting diagnostic data which include condition data for representing an image forming condition;

clock means for outputting time data when said diagnostic data is outputted;

storage means for storing a plurality of said diagnostic data and time data corresponding thereto in pairs respectively; and display means for displaying said plurality of diagnostic data stored i nsaid storage means in order of diagnosis.

25. An image forming apparatus in accordance with claim 24, further including a calling switch for inputting a display command, said display means displaying said plurality of diagnostic data stored in said storage means in order of diagnosis in response to said display command.

26. An image forming apparatus in accordance with claim 25, wherein said storage means erases those whose storage periods have passed a prescribed term from said stored data.

27. In an image forming apparatus for forming an image on a recording paper using image forming means, an image forming method including the steps of:

diagnosing the operating state of said image forming means and outputting diagnostic data which include condition data for representing an image forming condition;

outputting time data when said diagnostic data is outputted;

storing a plurality of said diagnostic data and time data corresponding thereto in pairs respectively; and displaying said stored plurality of diagnostic data in order of diagnosis.

28. An image forming method in accordance with claim 27, further including the steps of:

examining respective storage periods of said stored data, and erasing data exceeding a prescribed storage period.

29. An image forming apparatus including:

image forming means for forming an image on a recording paper;

diagnostic means for diagnosing the operating state of said image forming means and outputting diagnostic data which include condition data for representing an image forming condition;

clock means for outputting time data upon operation of said diagnostic means; and storage means for storing a plurality of said diagnostic data and time data corresponding to respective said diagnostic data.

30. An image forming apparatus in accordance with claim 29, wherein said time data include date data.

31. An image forming apparatus in accordance with claim 30, further including:

designation means for designating a desired day, and display means for displaying data of said designated day within said diagnostic data stored in said storage means.

32. An image forming apparatus in accordance with claim 29, wherein said time data include day-of-week data.

33. An image forming apparatus in accordance with claim 32, further including:

designation means for designating a desired day of the week, and display means for displaying data of said designated day of the week within said diagnostic data stored in said storage means.

34. An image forming apparatus in accordance with claim 30, further including:

erasing means for erasing those whose storage periods have passed a prescribed term from said data stored in said storage means.

35. A image forming apparatus in accordance with claim 34, wherein said prescribed term is decided in response to the type of said stored data.

36. An image forming apparatus in accordance with claim 30, further including:

display means for graphing said diagnostic data stored in said storage means in mapping with time data and displaying the same.

37. In an image forming apparatus for forming an image on a recording paper using image forming means, an image forming method including the steps of:

diagnosing the operating state of said image forming means and outputting diagnostic data which include condition data for representing an image forming condition;

outputting time data when said diagnosis is made; and storing a plurality of said diagnostic data and time data corresponding to respective said diagnostic data.

38. An image forming method in accordance with claim 37, further including the steps of:

inputting a display command, and displaying said stored diagnostic data in order of diagnosis.

39. An image forming method in accordance with claim 37, further including the steps of:

inputting a desired day, and displaying the diagnostic data corresponding to the input day within said stored diagnostic data.

40. An image forming method in accordance with claim 37, further including the steps of:

inputting a desired day of the week, and displaying the ones of said desired day of the week within said stored diagnostic data.

41. An image forming method in accordance with claim 37, further including the steps of:

examining respective storage periods of said stored data, and erasing data exceeding a prescribed storage period.

42. An image forming method in accordance with claim 37, further including a step of graphing said stored diagnostic data in mapping with time data and displaying the same.

43. An image forming apparatus connected with a management unit through a communication line, said image forming apparatus including:

image forming means having a plurality of movable elements for forming an image on a recording paper by cooperation thereof;

diagnostic means operating said plurality of movable elements without forming any image on said recording paper for diagnosing operating states thereof and outputting diagnostic data;

storage means for storing said diagnostic data, and transmission means for transmitting said diagnostic data stored in said storage means to said management unit through said communication line at predetermined time.

44. An image forming apparatus in accordance with claim 43, further including clock means for outputting time data, said transmission means transmitting said diagnostic data stored in said storage means to said management unit through said communication line when said clock means outputs specific time data.

45. An image forming apparatus in accordance with claim 43, wherein said diagnostic means diagnoses the operating state of said image forming means for outputting first type of diagnostic data and second type of diagnostic data, and said transmission means transmits said diagnostic data stored in said storage means to said management unit through said communication line at predetermined time and when said second type of diagnostic data are outputted.

46. An image forming apparatus in accordance with claim 43, wherein said diagnostic means outputs:

first diagnostic data indicating that said image forming means is normally operated, second diagnostic data indicating that said image forming means is in a first type of improper state, and third diagnostic data indicating that said image forming means is in a second type of improper state, and said transmission means transmits said first diagnostic data, said second diagnostic data and said third diagnostic data to said management unit through said communication line in a predetermined first cycle, in a predetermined second cycle and when diagnosis is made respectively.

47. An image forming apparatus in accordance with claim 43, wherein said transmission means transmits said diagnostic data stored in said storage means to said management unit through said communication line when a request is received from said management unit.

48. An image forming apparatus in accordance with claim 43, further including:

storage management means for erasing those exceeding a prescribed period from said diagnostic data stored in said storage means.

49. An image forming apparatus in accordance with claim 48, further including clock means for outputting time data upon operation of said diagnostic means, wherein said storage means stores said diagnostic data and said time data corresponding to said diagnostic data, and said storage management means determines said diagnostic date to be erased on the basis of said time data corresponding to respective said diagnostic data.

50. An image forming apparatus connected to a management unit through a communication line, said image forming apparatus including:

image forming means for forming an image on a recording paper;

diagnostic means for diagnosing the operating state of said image forming means and outputting diagnostic data in response to said operating state;

storage means for storing said diagnostic data;

transmission means for transmitting said diagnostic data stored in said storage means to said management unit through said communication line at a prescribed transmission frequency; and frequency set means for changing said prescribed transmission frequency in response to the type of said diagnostic data stored in said storage means.

51. In an image forming apparatus having a plurality of movable elements for forming an image on a recording paper by cooperation thereof and being connected with a management unit through a communication line, a management method for said image forming apparatus, including the steps of:

diagnosing the operating state of image forming means by driving said movable elements without forming any image on said recording paper at prescribed time;

creating diagnostic data on the basis of the result of said diagnosis;

storing diagnostic data on the basis of the result of said diagnosis;

storing said diagnostic data; and transmitting said stored diagnostic data to said management unit through said communication line at predetermined time.

52. A method in accordance with claim 51, wherein diagnosis of said image forming means is executed upon power supply.

53. A method in accordance with claim 51, further including the steps of:

examining storage periods of respective said stored diagnostic data, and erasing said diagnostic data stored in excess of a prescribed period.

54. In an image forming apparatus provided with image forming means having a plurality of movable elements for forming an image on a recording paper by cooperation thereof and being connected with a management unit through a communication line, a management method for said image forming apparatus, including the steps of:

driving said movable elements without forming any image on said recording paper at prescribed time for diagnosing the operating state of said image forming means;

creating diagnostic data on the basis of the result of said diagnosis;

storing said diagnostic data;

judging the type of said stored diagnostic data;

periodically transmitting said stored diagnostic data to said management unit through said communication line when said diagnostic data are of a first type; and immediately transmitting said stored diagnostic data to said management unit through said communication line when said diagnostic data are of a second type.

55. A method in accordance with claim 54, further including the steps of:

examining storage periods of respective said stored diagnostic data, and erasing said diagnostic data stored in excess of a prescribed period.

56. In an image forming apparatus having a plurality of movable elements for forming an image on a recording paper by cooperation thereof and being connected with a management unit through a communication line, a management method for said image forming apparatus, including the steps of:

diagnosing the operating state of image forming means by driving said movable elements without forming any image on said recording paper at prescribed time;

creating diagnostic data on the basis of the result of said diagnosis;

storing said diagnostic data;

deciding a transmission frequency in response to the type of said stored diagnostic data; and transmitting said stored diagnostic data to said management unit through said communication line at said decided transmission frequency.

57. An image forming apparatus including:

image forming means for forming an image on a recording paper;

diagnostic means for diagnosing the operating state of said image forming means as to a plurality of items and outputting diagnostic data as to respective said items;

state discrimination means for discriminating the operating state of said image forming means in a plurality of states on the basis of said diagnostic data; and management data creating means for creating management data in formats being responsive to said discriminated states.

58. An image forming apparatus in accordance with claim 57, wherein respective said formats includes prescribed diagnostic data respectively.

59. An image forming apparatus in accordance with claim 58, further including:

storage means for storing said management data, and calling means for calling said management data stored in said storage means.

60. An image forming apparatus in accordance with claim 72, further including:

clock means for outputting time data for the time when said diagnosis is made, and said management data include time data.

61. An image forming apparatus in accordance with claim 58, further including:

communication means for transmitting said management data to a management unit through a communication line.

62. An image forming apparatus in accordance with claim 61, wherein said communication means transmits said management data at different frequencies in response to the contents of said management data.

63. In an image forming apparatus for forming an image on a recording paper using image forming means, a management data creating method including the steps of:

diagnosing the operating state of said image forming means as to a plurality of items and outputting diagnostic data as to respective said items;

discriminating the operating state of said image forming means in a plurality of states in response to said diagnostic data; and preparing management data in formats being responsive to said discriminated states.

64. A method in accordance with claim 63, further including a step of storing said prepared management data.

65. A method in accordance with claim 63, wherein said respective formats include the minimum required diagnostic data for informing said discriminated states.

66. A method in accordance with claim 65, further including a step of transmitting said prepared management data to a management unit through a communication line.

67. An image forming apparatus connected to an external unit through a communication line, comprising:

a photoreceptor;

electrostatic latent image forming means for forming an electrostatic latent image on said photoreceptor;

developing means for developing said electrostatic latent image formed on said photoreceptor and forming a toner image;

transfer means for transferring said toner image formed on said photoreceptor onto a recording paper;

measuring means for measuring density of said toner image formed on said photoreceptor and outputting a measured density data;

estimation means for estimating density of said image transferred onto said recording paper on the basis of said measured density data and outputting an estimated image density data; and transmission means for transmitting said estimated image density data to said external unit through said communication line.

68. An image forming apparatus in accordance with claim 67, wherein said measuring means comprises a light emitting element for emitting light onto said photoreceptor and a light receiving element for receiving the light reflected by said photoreceptor.

69. An image forming apparatus in accordance with claim 67, wherein said transmission means is activated when a predetermined condition is satisfied.

70. An image forming apparatus connected to an external unit through a communication line, comprising:

image forming means for forming an image on a recording paper;

monitor means for monitoring the operating state of said image forming means and generating monitor data;

diagnostic means for detecting an improper portion of said image forming means based on said monitor data and judging whether the detected improper portion causes a first type of improper state or a second type of improper state; and transmission means for transmitting said detected improper portion and the type of said improper state caused by the detected improper portion to said external unit through said communication line.

71. An image forming apparatus in accordance with claim 70, wherein said transmission means is activated when a predetermined condition is satisfied.

72. A method for use in an image forming apparatus connected to an external unit through a communication line, the method comprising the steps of:

monitoring operational portions of said image forming apparatus and generating monitor data;

detecting an improper portion of said image forming apparatus based on said monitor data and judging whether the detected improper portion causes a first type of improper state or a second type of improper state; and transmitting said detected improper portion and the type of said improper state caused by the detected improper portion to said external unit through said communication line.

73. A method in accordance with claim 72, further comprising a step of storing said detected improper portion and the type of said improper state caused by the detected improper portion.

74. A method in accordance with claim 72, wherein said detected improper portion and the type of said improper state caused by the detected improper portion are transmitted when a predetermined condition is satisfied.

* * * * *